US011811138B2

(12) United States Patent
Zhang et al.

(10) Patent No.: US 11,811,138 B2
(45) Date of Patent: Nov. 7, 2023

(54) ANTENNA HARDWARE AND CONTROL

(71) Applicant: University of Massachusetts, Boston, MA (US)

(72) Inventors: Hualiang Zhang, Arlington, MA (US); Bowen Zheng, Dracut, MA (US)

(73) Assignee: University of Massachusetts, Boston, MA (US)

( * ) Notice: Subject to any disclaimer, the term of this patent is extended or adjusted under 35 U.S.C. 154(b) by 289 days.

(21) Appl. No.: 16/970,777

(22) PCT Filed: Feb. 19, 2019

(86) PCT No.: PCT/US2019/018521

§ 371 (c)(1),
(2) Date: Aug. 18, 2020

(87) PCT Pub. No.: WO2019/164813

PCT Pub. Date: Aug. 29, 2019

(65) Prior Publication Data

US 2021/0013618 A1 Jan. 14, 2021

Related U.S. Application Data

(60) Provisional application No. 62/633,671, filed on Feb. 22, 2018.

(51) Int. Cl.
*H01Q 15/00* (2006.01)
*H01Q 3/46* (2006.01)
(Continued)

(52) U.S. Cl.
CPC ..... *H01Q 15/002* (2013.01); *H01Q 3/46* (2013.01); *H01Q 15/0026* (2013.01);
(Continued)

(58) Field of Classification Search
CPC .... H01Q 15/002; H01Q 15/0026; H01Q 3/46; H01Q 21/0075; H01Q 21/065
See application file for complete search history.

(56) References Cited

U.S. PATENT DOCUMENTS 5,767,789 A * 6/1998 Afzali-Ardakani ..... H01Q 15/0013 340/572.1
7,330,161 B2 * 2/2008 Matsugatani ..... H01Q 15/008 343/753
(Continued)

FOREIGN PATENT DOCUMENTS

CN 103474775 * 3/2015
CN 107591626 * 1/2018
(Continued)

OTHER PUBLICATIONS

Fenn et al. "The development of phased-array radar technology." In: Lincoln Laboratory Journal. 2000 (2000) Retrieved on Apr. 13, 2019 (Apr. 13, 2019), from http:f/citeseerx.ist.psu.edu/viewdoc/download?doi=10.1.1.73.2849&rep=rep1 &type=pdf> entire document, pp. 1-20.
(Continued)

*Primary Examiner* — Awat M Salih
(74) *Attorney, Agent, or Firm* — Armis IP Law, LLC

(57) ABSTRACT

The communication system as described herein includes an input feed, a source, and a tuner device. The input feed receives an input signal. The source emits a wireless signal based on the received input signal. The tuner device is disposed adjacent to the source emitting the wireless signal. The tuner device receives the wireless signal emitted from the source and produces a wireless output. In one embodiment, the tunable device includes multiple individually
(Continued)

controlled window regions to control a radiation pattern of the wireless output transmitted from the tuner device.

39 Claims, 20 Drawing Sheets

(51) Int. Cl.
*H01Q 19/06* (2006.01)
*H01Q 21/00* (2006.01)
*H01Q 21/06* (2006.01)

(52) U.S. Cl.
CPC ..... *H01Q 19/062* (2013.01); *H01Q 21/0075* (2013.01); *H01Q 21/065* (2013.01)

(56) References Cited

U.S. PATENT DOCUMENTS

2005/0012677 A1* 1/2005 Brown ..... H01Q 1/364 343/909
2005/0179614 A1* 8/2005 Nagy ..... H01Q 3/46 343/909
2010/0184370 A1 7/2010 Zheng et al.
2011/0098033 A1* 4/2011 Britz ..... H01Q 15/0086 333/99 R
2014/0022125 A1 1/2014 Zhu et al.
2014/0049434 A1 2/2014 Greene et al.
2015/0229034 A1 8/2015 Kim et al.

FOREIGN PATENT DOCUMENTS

EP 3300172 A1 * 3/2018 ..... H01Q 1/246
JP 2013509097 A 3/2013
KR 20160086252 * 7/2016

OTHER PUBLICATIONS

PCT Search Report, PCT/US2019/018521, dated May 6, 2019, pp. 1-12.
Japanese Office Action, JP 2020-544247, dated Jan. 5, 2023, pp. 5.

* cited by examiner

ANTENNA HARDWARE AND CONTROL

RELATED APPLICATIONS

This application is a national stage filing of PCT application No.: PCT/US2019/018521 filed Feb. 19, 2019 entitled ANTENNA HARDWARE AND CONTROL, which claims priority to U.S. Provisional Patent Application No. 62/633,671 filed Feb. 22, 2018 entitled ANTENNA HARDWARE AND CONTROL, the entire teachings of which are incorporated herein by reference.

GOVERNMENT RIGHTS

This invention was made with Government support under Award No. N00014-17-1-2008 awarded by the Office of Naval Research. The U.S. government may have certain rights in the invention.

BACKGROUND

Conventional beam-steering antenna systems (also known as phased array antennas or phased arrays) are typically constructed using beam-forming networks in connection with individually controlled antenna arrays. During operation, each antenna in the array generates a respective electromagnetic signal.

BRIEF DESCRIPTION OF EMBODIMENTS

Conventional beam-steering antenna systems suffer from deficiencies. For example, conventional beam-forming networks require very complicated radio-frequency (RF) circuits, analog circuits, digital circuits, etc. As a result, such circuits and systems are typically large in size, consume high power, and are costly.

Embodiments herein include novel architectures for beam-steering antenna systems. Specifically, the system as described herein includes a radiating aperture (based on tunable meta-surfaces with an integrated feeding/integrated launcher) employed to function as a both beam-forming network and/or a radiating antenna array (for transmitter and receiver). As a result, embodiments herein achieve significant system complexity reduction and cost reduction over conventional/existing beam-forming/beam-steering techniques, providing a novel low-profile and low-cost beam-steering antenna system for transmitting and receiving signals.

Note that the proposed techniques can be applied to any suitable one or more applications such as phased array systems for communication (e.g. 5G communication system), sensing, imaging, RADAR (Radio Detection and Ranging), etc., impacting all related technology sectors.

More specifically, in contrast to conventional antenna devices, embodiments herein include an apparatus/system comprising: an input feed to receive an input signal; a source from which to emit a wireless signal based on the external input signal; and a tuner disposed adjacent to the source. The tuner is operable to receive the wireless signal emitted from the source to produce a wireless output. In one embodiment, the tuner device includes multiple individually controlled window regions to control a radiation pattern of a corresponding wireless output transmitted from the tuner device.

In one embodiment, the multiple individually controlled window regions (i.e., the tunable radiating apertures based on tunable meta-surfaces) include at least a first window region (e.g. a first meta-surface unit cell), a second window region (e.g. a second meta-surface unit cell), a third window region (e.g. a third meta-surface unit cell), etc. In such an embodiment, the first window region receives a first portion of the wireless signal (such as one or more electromagnetic signals) emitted from the source; the second window region receives a second portion of the wireless signal emitted from the source; the third window region receives a third portion of the wireless signal emitted from the source; and so on.

The system as discussed herein further includes a controller to control settings of the multiple individually controlled window regions.

In one embodiment, the controller controls or varies the settings (such as via capacitance tuning) of the window regions to control an amplitude and/or phase of the different portions of wireless output and steer the wireless output in a desired direction. To this end, via capacitance tuning (or any other suitable type of tuning) of the first window region, the first window region of the tuner device controls a phase and/or amplitude of the received first portion of the wireless signal (received from the source) to produce a corresponding first portion of the wireless output transmitted from the first window region; via capacitance tuning of the second window region, the second window region of the tuner device controls a phase and amplitude of the received second portion of the wireless signal (received from the source) to produce a corresponding second portion of the wireless output transmitted from the second window region; and so on.

In accordance with further embodiments, each of the multiple individually controlled window regions is substantially planar (or alternatively another suitable shape such as concave, convex, etc.) and modifies attributes of a respective received portion of the wireless signal from the source (such as a launcher that generates one or more electromagnetic signal) to produce a corresponding portion of the output signal.

In accordance with further example embodiments, the system as described herein includes a controller. The controller controls settings of the multiple individually controlled window regions; the controller is operable to vary the settings to steer the wireless output in a desired direction. Alternatively, the settings of one or more the window regions can be fixed.

In one embodiment, the settings produced by the controller control corresponding resonant frequencies associated with the multiple individually controlled window regions.

In accordance with yet further embodiments, each respective window region of the multiple individually controlled window regions controls radiation of a corresponding incident portion of the emitted wireless signal received by the respective window.

In yet further embodiments, each of the multiple individually controlled surface regions includes multiple windows, each of which (based on control input) controls radiation of an incident portion of the emitted wireless signal received from the source.

In still further embodiments, as previously discussed, the multiple individually controlled window regions can include any number of window regions such as a first window region, a second window region, third window region, fourth window region, etc.

In accordance with further embodiments, the first window region of the tuner device receives a first portion of the wireless signal emitted from the source; the second window region of the tuner device receives a second portion of the wireless signal emitted from the source; and so on.

Further embodiments herein include, via a controller, controlling the first window region of the tuner device to change a phase and/or amplitude of the received first portion of the wireless signal to produce a corresponding first portion of the wireless output transmitted from the first window region; and controlling the second window region of the tuner device to control a phase and/or amplitude of the received second portion of the wireless signal to produce a corresponding second portion of the wireless output transmitted from the second window region.

In accordance with further example embodiments, the controller controls settings of the multiple individually controlled window regions, the controller operable to vary the settings resulting in steering of the wireless output in a desired direction.

In yet further embodiments, the tuner device includes: i) a first stack of aligned window regions (in different layers); the first stack of window regions is operable to receive a first portion of energy from the wireless signal emitted from the source, and ii) a second stack of aligned window regions (in the different layers); the second stack of window regions is operable to receive a second portion of energy from the wireless signal emitted from the source. In one embodiment, one or more of the window regions in the first stack is tunable to adjust a phase and/or magnitude associated with the first portion of energy passing through the first stack; one or more of the aligned window regions in the second stack is tunable to adjust a phase and/or magnitude associated with the second portion of energy passing through the second stack.

In still further embodiments, each of the stacks potentially includes one or more layers of passive metalized patches or pads. For example, in one embodiment, the first stack can be configured to include a first passive metalized layer of regions of material disposed on a respective substrate (e.g dielectric material, air, etc.); the second stack can be configured to includes a second passive metalized layer of regions of material disposed on a substrate (e.g., dielectric material, air, tc.), and so on.

Alternatively, as previously discussed, the first stack includes a first set of multiple passive metalized material layers in addition to one or more active layers as described herein; the second stack includes a second set of multiple passive metalized material layers in addition to one or more active layers as described herein. As a further example embodiment, a first passive metalized material layer (region) of the first stack is disposed at a first axial end of the first stack on a substrate; a second passive metalized material layer of the first stack is disposed at a second axial end of the first stack opposite the first axial end of the first stack on a substrate. A first passive metalized material layer of the second first stack is disposed at a first axial end of the second stack on a proper substrate; a second passive metalized material layer of the second stack is disposed at a second axial end of the second stack opposite the first axial end of the second stack on a proper substrate.

Note that further embodiments herein include an apparatus comprising: a controller and a tuner device controlled by the controller. The tuner device includes multiple window regions through which different respective portions of a received wireless signal pass. The controller is operable to tune the multiple window regions to produce a wireless output signal from the received wireless signal (from the integrated launcher/integrated feeding); the tuned window regions modify the different respective portions of the respective received wireless signal passing therethrough.

In accordance with further embodiments, each of the multiple individually controlled window regions is substantially planar and modifies one or more attributes of a respective received portion of the wireless signal to produce a corresponding portion of the output signal.

Further embodiments herein include a controller operable to variably tune settings of the multiple individually controlled window regions to vary steering of the wireless output in a desired direction.

In yet further embodiments, the controller is operable to variably tune settings of the multiple individually controlled window regions to receive wireless signals from different directions.

In still further embodiments, each respective window region of the multiple individually controlled window regions controls radiation of a corresponding incident portion of the received wireless signal received by the respective window.

In accordance with yet further embodiments, the multiple controlled window regions (in different stacks) include a first window region and a second window region. The first window region receives a first portion of the received wireless signal; and the second window region receives a second portion of the received wireless signal. The first window region of the tuner device is operable to control a phase and/or amplitude of the received first portion of the wireless signal and produce a corresponding first portion of the wireless output transmitted from the first window region; the second window region of the tuner device is operable to control a phase and/or amplitude of the received second portion of the wireless signal and produce a corresponding second portion of the wireless output transmitted from the second window region. In accordance with further embodiments, the controller is operable to vary the settings of tuning each of the window regions, steering the wireless output (one or more wireless signals) in different desired directions in different timeframes.

Note further that any of the resources as discussed herein can include one or more computerized devices, controllers, wireless communication devices, gateway resources, mobile communication devices, sensors, servers, base stations, wireless communication equipment, communication management systems, controllers, workstations, user equipment, handheld or laptop computers, or the like to carry out and/or support any or all of the method operations disclosed herein. In other words, one or more computerized devices or processors can be programmed and/or configured to operate as explained herein to carry out the different embodiments as described herein.

Yet other embodiments herein include software programs to perform the steps and operations summarized above and disclosed in detail below. One such embodiment comprises a computer program product including a non-transitory computer-readable storage medium (i.e., any computer readable hardware storage medium) on which software instructions are encoded for subsequent execution. The instructions, when executed in a computerized device (hardware) having a processor, program and/or cause the processor (hardware) to perform the operations disclosed herein. Such arrangements are typically provided as software, code, instructions, and/or other data (e.g., data structures) arranged or encoded on a non-transitory computer readable storage medium such as an optical medium (e.g., CD-ROM), floppy disk, hard disk, memory stick, memory device, etc., or other a medium such as firmware in one or more ROM, RAM, PROM, etc., or as an Application Specific Integrated Circuit (ASIC), etc. The software or firmware or other such configurations can be installed onto a computerized device to cause the computerized device to perform the techniques explained herein.

Accordingly, embodiments herein are directed to a method, system, computer program product, etc., that supports operations as discussed herein.

One embodiment includes a computer readable storage medium and/or system having instructions stored thereon to support control according to embodiments herein. The instructions, when executed by the computer processor hardware, cause the computer processor hardware (such as one or more co-located or disparately processor devices or hardware) to: individually control window regions of a tuner device that is operable to receive a wireless signal emitted from a source, control of the window regions controlling a radiation pattern of a wireless output transmitted from the tuner device.

The ordering of the steps above has been added for clarity sake. Note that any of the processing steps as discussed herein can be performed in any suitable order.

Other embodiments of the present disclosure include software programs and/or respective hardware to perform any of the method embodiment steps and operations summarized above and disclosed in detail below.

It is to be understood that the system, method, apparatus, instructions on computer readable storage media, etc., as discussed herein also can be embodied strictly as a software program, firmware, as a hybrid of software, hardware and/or firmware, or as hardware alone such as within a processor (hardware or software), or within an operating system or a within a software application.

As discussed herein, techniques herein are well suited for use in the field of conveying, transmitting, steering, analyzing, receiving, etc., wireless communications in wireless network environment. However, it should be noted that embodiments herein are not limited to use in such applications and that the techniques discussed herein are well suited for other applications as well.

Additionally, note that although each of the different features, techniques, configurations, etc., herein may be discussed in different places of this disclosure, it is intended, where suitable, that each of the concepts can optionally be executed independently of each other or in combination with each other. Accordingly, the one or more present inventions as described herein can be embodied and viewed in many different ways.

Also, note that this preliminary discussion of embodiments herein (BRIEF DESCRIPTION OF EMBODIMENTS) purposefully does not specify every embodiment and/or incrementally novel aspect of the present disclosure or claimed invention(s). Instead, this brief description only presents general embodiments and corresponding points of novelty over conventional techniques. For additional details and/or possible perspectives (permutations) of the invention(s), the reader is directed to the Detailed Description section (which is a summary of embodiments) and corresponding figures of the present disclosure as further discussed below.

Figure 1:
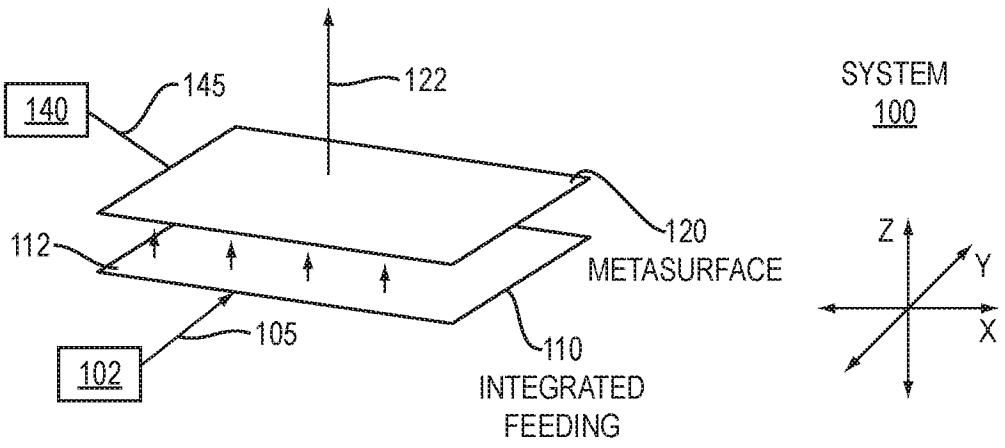
FIG. 1 is an example diagram illustrating a wireless system according to embodiments herein.

The foregoing and other objects, features, and advantages of the invention will be apparent from the following more particular description of preferred embodiments herein, as illustrated in the accompanying drawings in which like reference characters refer to the same parts throughout the different views. The drawings are not necessarily to scale, with emphasis instead being placed upon illustrating the embodiments, principles, concepts, etc.

DETAILED DESCRIPTION

The communication system as described herein includes an input feed, a source, and a tuner device. The input feed receives an input signal. The source emits a wireless signal based on the received input signal. The tuner device is disposed adjacent (at a subwavelength distance) to the source emitting the wireless signal. The tuner device receives the wireless signal emitted from the source and produces a wireless output. In one embodiment, the tunable device includes multiple individually controlled window regions to control a radiation pattern of the wireless output transmitted from the tuner device. In accordance with further embodiments, the tuner device is operable to receive wireless signals from one or more communication devices operated in a network environment.

Accordingly, embodiments herein include one or more meta-surface layers and/or electromagnetic wave source/integrated launcher/receiver. The meta-surfaces as described herein include one or more tunable radiation apertures (a.k.a., window regions) and potentially one or more passive metalized regions. Such a system can be widely used in different wireless systems to replace the existing antennas. For example, it can be easily used in the radar systems to replace the existing antennas. By doing so, the static, non-tunable beam for a conventional radar can be replaced by a two-dimensional steerable, high efficiency beam, which gives the radar system a wider coverage and higher resolution, also introduces new applications (e.g. imaging, tracking, etc.) to the existing radar system without introducing high-cost circuits/components or complicated system integration like phased arrays.

Now, more specifically, FIG. 1 is an example diagram illustrating a wireless system according to embodiments herein.

In this example embodiment, the wireless system 100 includes source 110. Source 110 (such as an integrated launcher) receives input 105 from resource 102 and produces wireless signal 112 such as a highly directive electromagnetic (i.e., EM) wave or waves transmitted orthogonally from a surface of source 110. System 100 further includes tuner device 120 to derive the wireless output 122 based on wireless signal 112.

During operation, as further described herein, tuner device 120 (a.k.a., meta-surface or tunable radiating aperture) controls one or more attributes such as the phase, amplitude, etc., of components that make up the wireless output 122 (EM signal or wave) emitted from the tuner device 120. As further discussed herein, via control signals 145, the controller 140 controls the tuner device 120 to control attributes of wireless output 122 to provide beam-forming, beam-scanning, beam-shaping, etc. Note that the wireless signal 112 and/or wireless output 120 can be encoded, modulated, etc., to include any suitable data or data payload.

As further discussed herein, note that tuner device 120 (such as one or more metasurface layers) also can be configured to serve as a device, apparatus, etc., in which to receive a wireless signal (such as an electromagnetic wave). Via the principles as described herein, the controller 140 can be configured to tune the tuner device 120 to receive one or more wireless signals from any different selected direction for further analysis (such decoding, demodulation, etc.).

Figure 2:
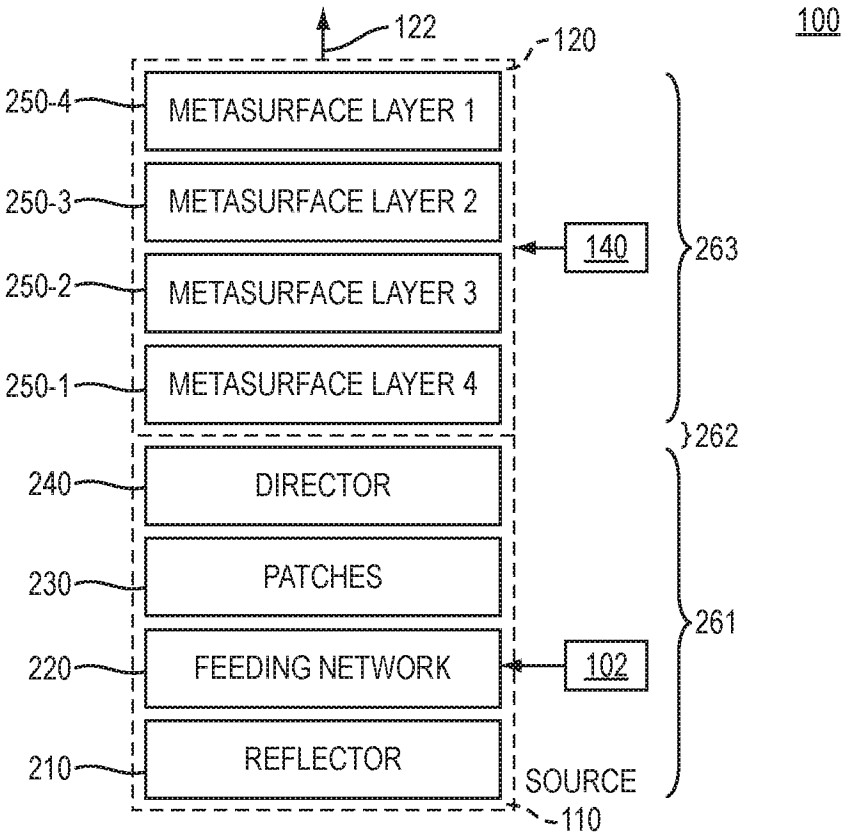
FIG. 2 is an example diagram illustrating different attributes of a wireless system according to embodiments herein.

FIG. 2 is an example diagram illustrating different attributes of a wireless system according to embodiments herein.

As shown in FIG. 2, the source 110 (integrated feed/integrated launcher/receiver) is connected to a respective source 102 (an external RF signal sourced connected by a SMA connector and coaxial cables or printed circuit board (PCB) traces); the tuner device 120 (active meta-surface part) is controlled by the controller 140 (an external control system) to control beam-forming functions.

In one embodiment, the system 100 operates up to, around, or at 5 GHz (2-10 GHz, or any other suitable frequency). In one nonlimiting example embodiment, a total thickness of all layers in the tuner device 120 and the integrated launcher including 102 is 33 mm (millimeters) or any other suitable value for a combination of the layers. In this example embodiment, there are total 8 layers; 4 layers are for integrated launcher and 4 layers are for the meta-surface. The number of layers may vary depending on the embodiment. For example, the source 110 can be configured using a single layer or multiple layers; the meta-surface layers can be configured using 2, 3, 4, 5, or any suitable number of layers.

By way of further non-limiting example embodiment, the size of a respective active region (window region as further discussed below) is 108 mm×108 mm (1.64λ×1.64λ), with a gain of 14 dBi (62% aperture efficiency), although these dimensions and settings can vary depending on the embodiment.

The reflector 210 of the source 110 can be a piece of metal sheet or printed circuit board with the copper foil disposed thereon.

In one embodiment, one or more gaps in the design are filled with air. Alternatively, gaps between respective layers of the system 100 can be filled with material as dielectric or other suitable material through which electromagnetic waves pass. In one embodiment, each of the substrates associated with source 110 (such as reflector 210, feeding network 220, patches 230, director 240) are low-loss RF laminates manufactured by depositing copper foil on all or a portion of respective dielectric sheets.

In one embodiment, each of the layers 210, 220, 230, and 240 serves a different purpose. For example, in one embodiment, reflector 210 is operable to reduce the back-lobe that meta-surfaces 250 create, especially in some cases of the beamforming.

Feeding network 220 is operable to divide power from the input port and couple the power to the upper layers.

Patches layer 230 (field or arrays of patches) is operable to generate radiation to the director 240.

Director 240 is used as a buffer between the integrated feeding/launcher section of source 110 and meta-surface layers 250. In one embodiment, the director 240 increases the gain of meta-surface layers 250 and generates a more uniform radiation in near field. Note that director 240 can be used as a filter to limit and correct a working frequency.

In one non-limiting example embodiment, the specification of the source 110 (integrated feed/integrated launcher) are as follows:

Active region size: 108 mm×108 mm
Gain 15.8 dBi
Aperture efficiency >95%
Layers 4
Thickness 11 mm Again, the settings of these values can vary depending on the embodiment.

Embodiments herein include operating the system to operate at any suitable frequency such as greater than 100 MegaHertz (MHz) and one hundred or more GigaHertz (GHz).

In one embodiment, the respective source 102 in FIG. 2 controls generation of the wireless signal (one or more electromagnetic waves) to be around 5 GHz. For such an application, in one embodiment, dimensions of active tuning window regions disposed on the one or more metasurface layers 250 are around 24 mm×24 mm (0.4λ×0.4λ, where λ represents a wavelength of the launched wireless signal 112), although the window regions as described herein can be any suitable size depending on the embodiment.

In general, any dimension X-Y dimension smaller than 0.5λ for a window region size will work to support embodiments herein. However, a desirable range may be, for a low cost application, the between 0.25λ to 0.5λ. If a window region is too small in size, more window regions as described herein will be needed to cover the same area, hence increase fabrication/assembly costs.

In one embodiment, the distance or gap 262 between the director 240 (such as launcher) and the meta-surface layer 250-1 (layer 4) is 4 mm (such as λ/15), however, the typical range for gap 262 can vary such as between λ/20 to λ/2, or any other suitable value. In certain instances, there is a tradeoff for compactness and performance for a size of gap 262 between λ/20 to λ/10, a distance bigger than λ/10 will have similar performance.

Note further that the distance 263 such as separation between layer 250-1 and layer 250-4 can be any suitable value such as 15 mm (or λ/4); the total thickness for launcher (261) is 12 mm (λ/5). In one embodiment, the total thickness of the whole device (including distance 261, gap 262, and distance 263) is about λ/2. In such an instance, the total thickness distance 261, gap 262, and distance 263 is subwavelength (i.e., the total thickness is smaller than a wavelength of corresponding wireless signal 112 or wireless output 122). However, as previously discussed, the total thickness of 261, 262, and 263 can be any suitable value and vary depending on the embodiment.

In one embodiment, the respective source 102 controls generation of the wireless signal (one or more electromagnetic waves) to be around 24 GHz (such as instead of around 5 GHz).

In accordance with further embodiments, the window size of a respective window region can be a setting such as: 6 mm×6 mm (0.48λ×0.48λ) in the X-Y plane; a window region smaller than 0.5λ may be suitable in an application, but further consideration may be given to provide a low cost application in which the respective dimensions fall in a range between 0.25λ to 0.5λ. If a window region size is too small, it may introduce more the need for more windows to cover a same area, hence increase the cost in fabrication and assembly. In a similar manner as previously discussed, the size of each of the window regions can be any suitable value depending on the embodiment.

In accordance with further embodiments, as previously discussed, a distance 262 between launcher (source 110) and tuner device 120 can be any suitable value. In one embodiment, the gap is 0.8 mm (λ/15.625), but also can be chosen from a range between from λ/20 to λ/2.

In one non-limiting example embodiment, the total thickness (such as distance 263) between layer 250-1 and 250-4 is chosen as 6 mm (millimeters) (or λ/2.5); this is thicker because of the thickness of substrates and an extra layer. In one embodiment, the total thickness for source 110 (such as an electromagnetic wave launcher) is 0.3 mm (λ/42), so the total thickness is about λ/2. In a similar manner as previously discussed, the total thickness can be any suitable value depending on the embodiment.

Figure 11A:
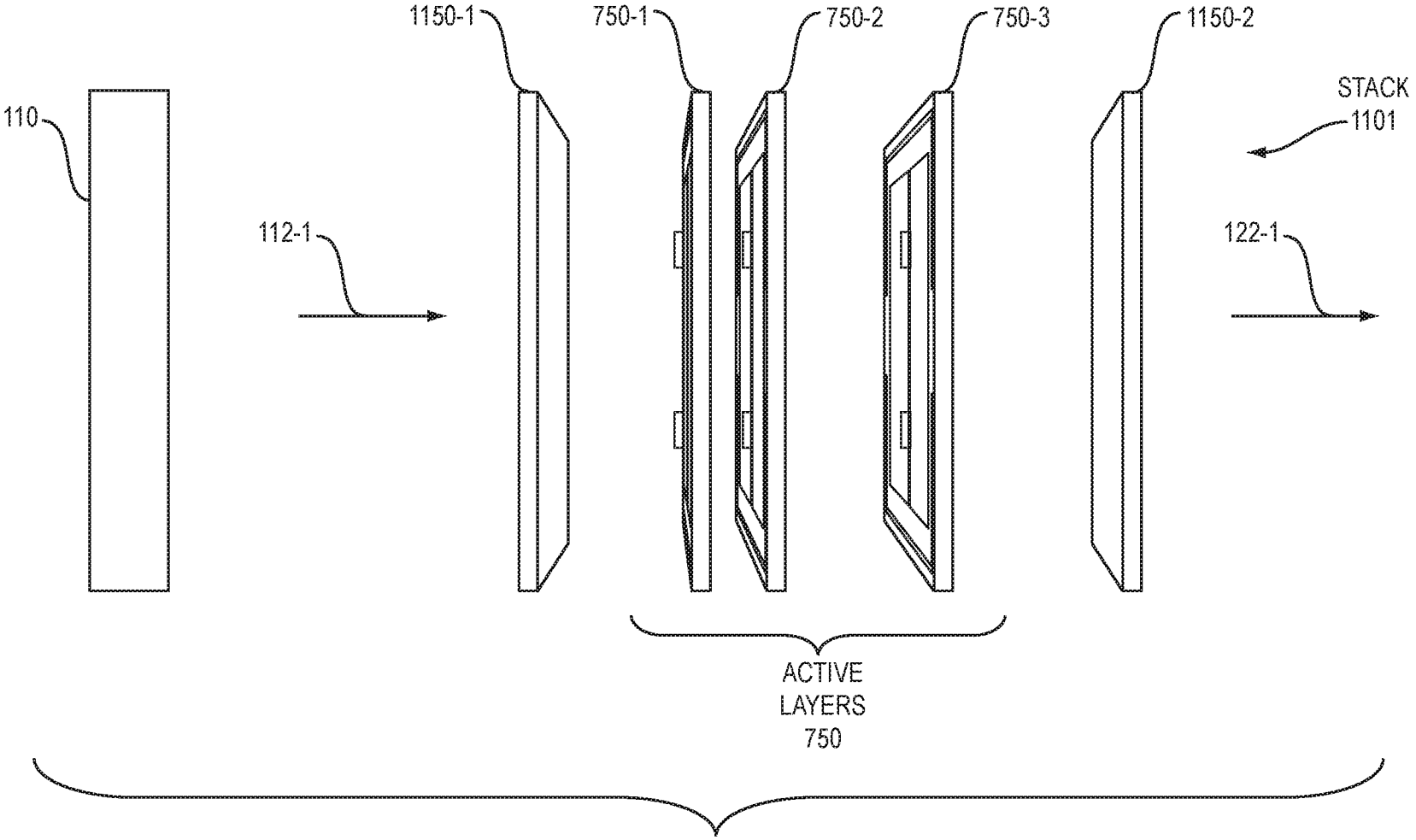
FIG. 11A is an example side view diagram illustrating a stack including window regions and corresponding multiple matching metalized layers according to embodiments herein.
Figure 11B:
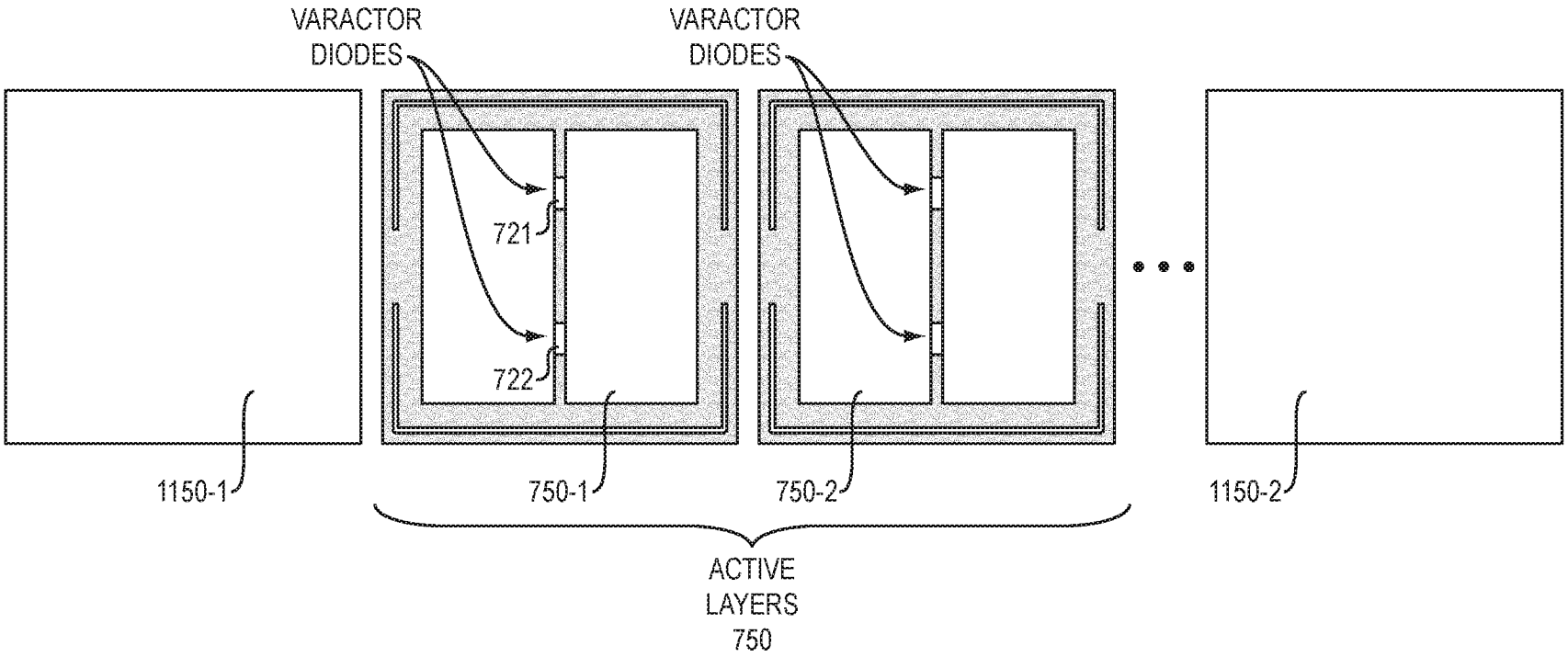
FIG. 11B is an example top view diagram illustrating laid out window regions and corresponding multiple matching metalized passive regions (such as pads) according to embodiments herein.

Further embodiments herein, such as discussed in FIGS. 11A and 11B, each matching layer patch is sized for 2.5 mm×2.5 mm in the X-Y plane (such as 0.2λ×0.2λ or other suitable value) with a window region size of 6 mm×6 mm (such as 0.48λ×0.48λ or other suitable value) for both active and passive layers. In a similar manner as previously discussed, the total thickness can be any suitable value depending on the embodiment.

Figure 3:
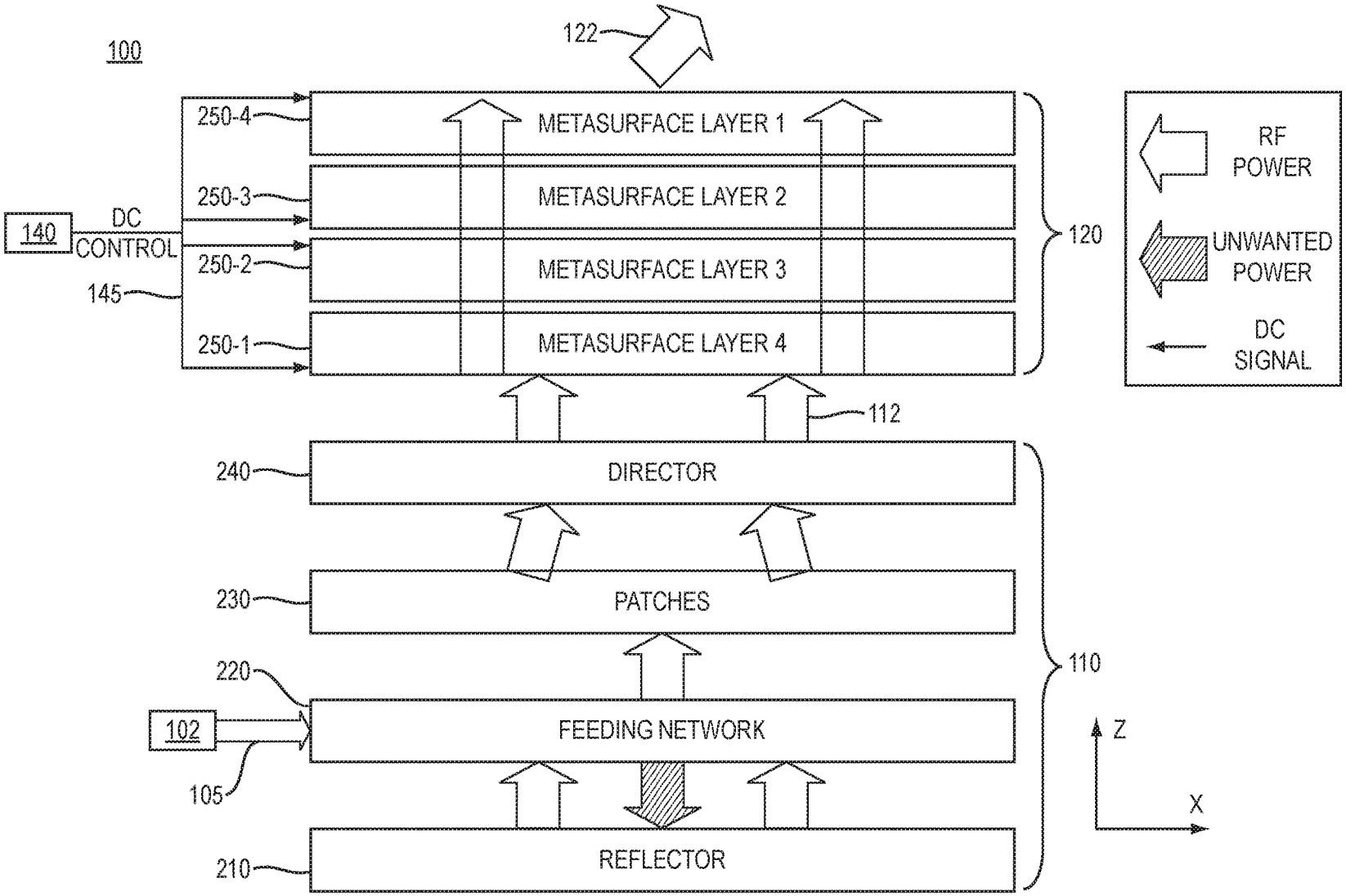
FIG. 3 is an example diagram illustrating generation of a wireless output signal based on a received input signal according to embodiments herein.

FIG. 3 is an example diagram illustrating generation of a wireless signal according to embodiments herein.

As shown, system 100 includes resource 102 (such as a driver) to drive the feeding network 220 associated with source 110. As previously discussed, and as shown, source 110 includes reflector 210 to prevent unwanted power (back-lobe) from being emitted in the wrong direction.

As further shown, the feeding network 220 outputs RF energy to layer of individual patches 230 disposed on a respective substrate. Also as shown, the output of RF energy (such as one or more electromagnetic waves) from the layer of patches 230 is not necessarily uniform.

Note that an example of feeding network 220 and corresponding patches 230 is shown in related application U.S. Provisional Patent Application Ser. No. 62/486,133 entitled "PLANAR-SHAPED ANTENNA DEVICE AND ANTENNA ARRAYS," filed on Apr. 17, 2017, the entire teachings of which are incorporated herein by this reference.

As further shown, the patches 230 output respective RF energy to director 240. Director 240 includes a field of metallic shapes to convert the received RF energy into overall wireless signal 112, which will be more uniform in near field than the RF energy directly from patches 230.

As further shown, tuner device 120 includes multiple tunable layers 250 to derive the wireless output 122 from the received wireless signal 112.

Figure 4:
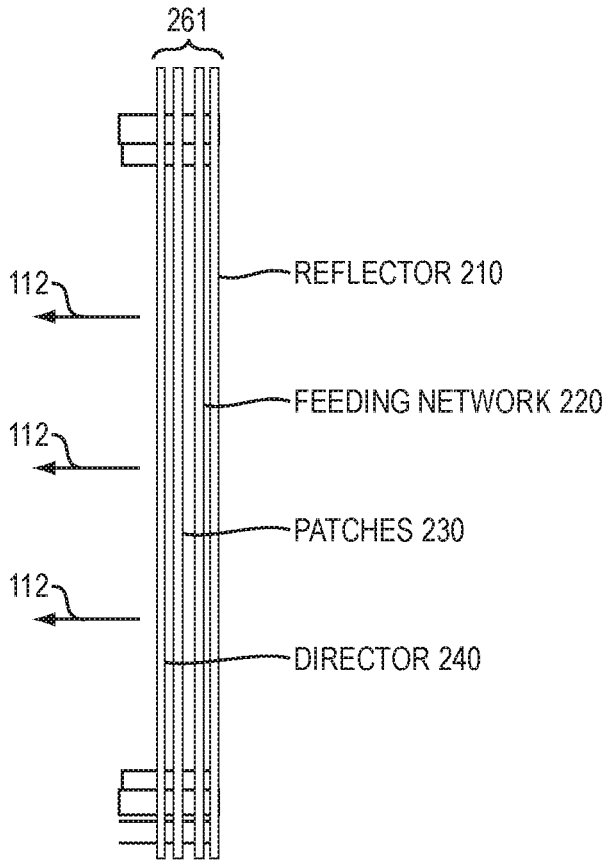
FIG. 4 is an example diagram illustrating of a source operable to generate a wireless signal according to embodiments herein.

FIG. 4 is an example side view diagram illustrating a source operable to generate a wireless signal according to embodiments herein.

As shown, the source 110 includes a stacking of the reflector 210, feeding network 220, patches 230, and director 240. As previously discussed, the combination of these layered components of source 110 produces the wireless signal 112.

In one embodiment, a thickness (distance) 261 of the integrated feeding/launcher (source 110) is sub-wavelength (i.e., much thinner than a wavelength of the carrier frequency or operating frequency associated with the wireless output 122).

Referring again to FIG. 2, note that a thickness (distance 263) of the tuner device 120 is sub-wavelength (i.e., much thinner than a wavelength of the wireless output 122); and the distance 262 of separation between the integrated feeding/launcher and the tuner device 263 is sub-wavelength (much thinner than a wavelength of the wireless output 122).

In one embodiment, as previously discussed, the overall thickness of system 100 (thickness 261, thickness 262, and thickness 263) is sub-wavelength (e.g. in one embodiment, the overall profile or combination thickness of source 110 and tuner device 120 is less than one third the wavelength of the transmitted wireless output 122).

Figure 5:
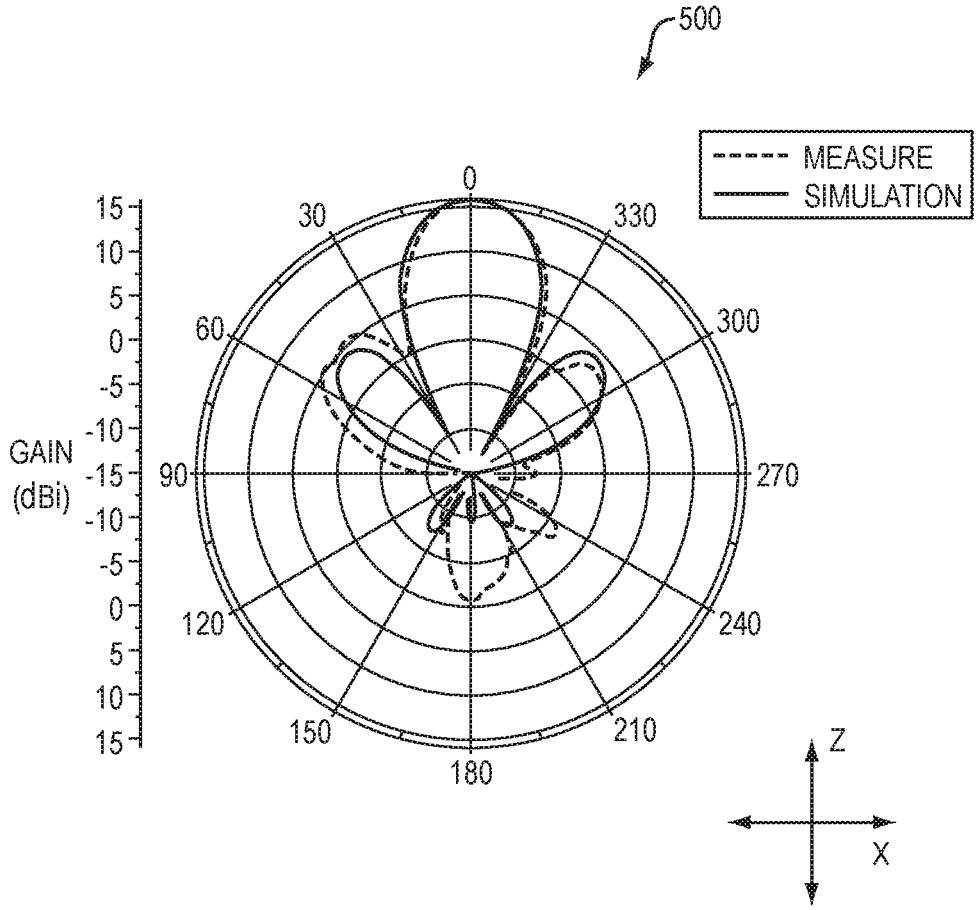
FIG. 5 is an example diagram illustrating of an outputted radiation pattern from the source (i.e., integrated feeding/integrated launcher according to embodiments herein.

FIG. 5 is an example diagram illustrating of an outputted radiation pattern according to embodiments herein.

Graph 500 illustrates an example radiation pattern associated with wireless signal 112 at 5 GHz. As previously discussed, this output varies depending on the embodiment.

Figure 6:
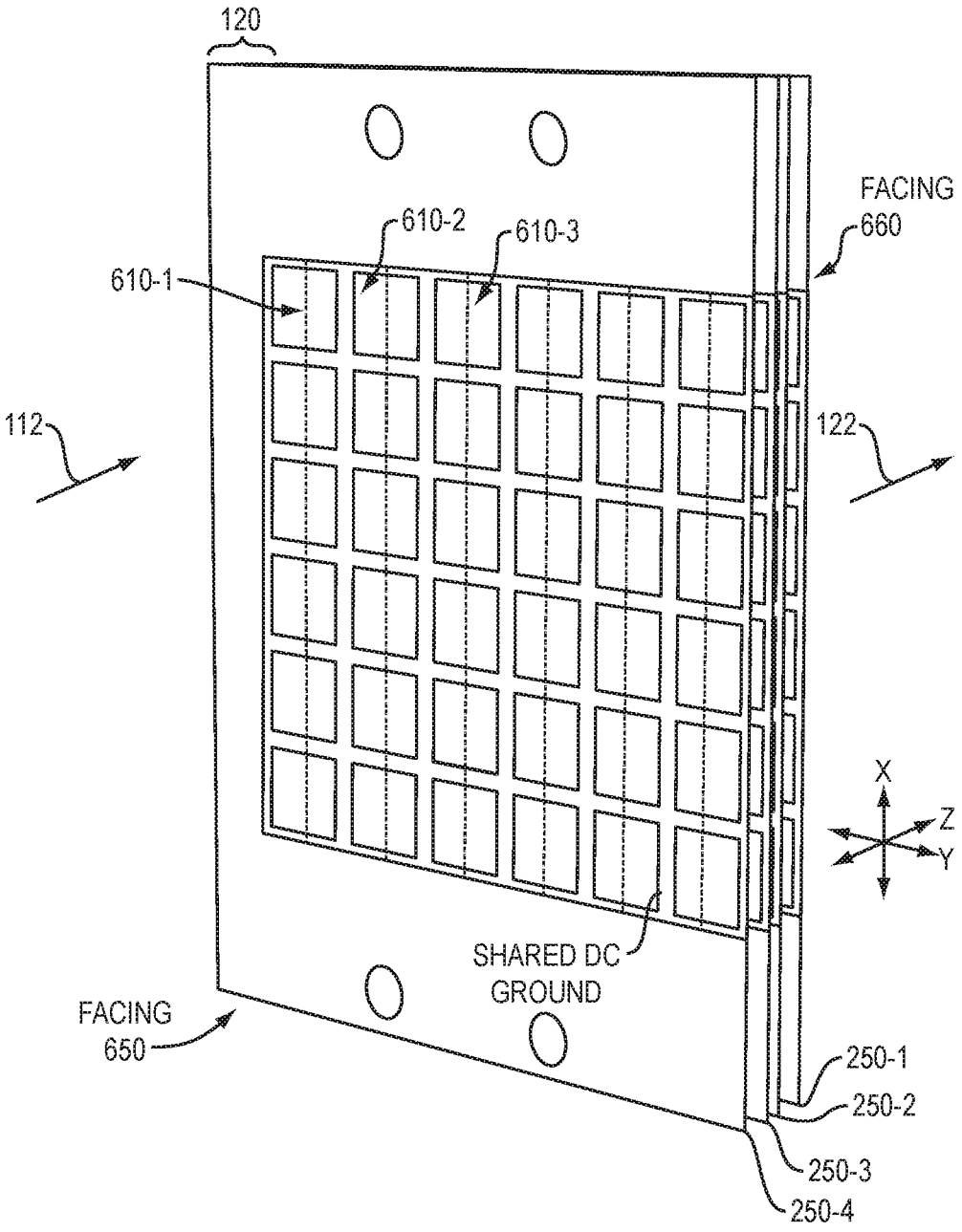
FIG. 6 is an example diagram illustrating a tunable radiating aperture including multiple window regions in respective multiple layers of a tuner device according to embodiments herein.

FIG. 6 is an example diagram illustrating a tuner resource including multiple aligned window regions in a layered stack of substrates according to embodiments herein.

As previously discussed, tuner device 120 is disposed adjacent (e.g. the distance is smaller than or equal to one tenth of the wavelength) such as parallel to the source 110.

Further, note that in one embodiment, one or more gaps or layers in the tuner device 120 of multiple tunable window regions is filled with air or material such as dielectric material or other suitable material (that passes electromagnetic waves).

In one embodiment, each of the substrates 250 (such as fabricated from low-loss RF laminates are manufactured by depositing copper foil on a portion (such as perimeter region, center trace, etc.) of respective dielectric sheets (dielectric material). A dielectric (or dielectric material) is an electrical insulator that passes electromagnetic ways.

As further shown, the inner portion (free of metal material or metal layer) of each of the window regions in FIG. 6 is generally free to pass the corresponding incoming portion of an electromagnetic wave. As described herein, tuning of each window region controls attributes of the passing electromagnetic wave to an appropriate outputted electromagnetic wave portion.

During operation, the tuner device 120 receives the wireless signal 112 emitted from the source 110 to produce wireless output 122. As shown, the tunable device 120 includes multiple individually controlled window regions 610 (such as window region 610-1, window region 610-2, etc., in each different layer of tuner device 120) to control a radiation pattern of the wireless output 122 transmitted from the tuner device 120.

In one embodiment, the tuner device 120 is configured to include an array of window regions (e.g., such as metasurface-based tunable radiating apertures in the X-Y plane, which are aligned in different layers along the Z-axis).

In this example embodiment, each window region of the tuner device 120 includes 4 meta-surface layers (such as layer 250-1, 250-2, 250-3, and 250-4) to control the respective output. Each layer includes a multiple-dimensional array (such as in the X-Y plane) of window regions 610 operable to provide control of producing the wireless output 122 (input electromagnetic signal) based on received wireless signal 112 (output electromagnetic signal).

Further in this example embodiment, the first window region 610-1 receives a corresponding first portion of the wireless signal 112 emitted from the source 110; the second window region 610-2 receives a second portion of the wireless signal 112 emitted from the source 110; and so on.

During operation, controller 140 produces control settings to control the multiple individually controlled window regions (i.e. meta-surface unit cells) on each of the layers 250.

In one embodiment, the controller 140 controls or varies the settings of voltages applied to the window regions (i.e., unit cells or stacks of window regions) to steer the wireless output 122 in a desired direction. In such an instance, the first window region 610-1 of the tuner device 110 controls one or more attributes such as a phase and amplitude of the received first portion of the wireless signal 112 to produce a corresponding first portion of the wireless output 122 transmitted from the first window region 610-1; the second window region 610-2 of the tuner device 120 controls a phase and amplitude of the received second portion of the wireless signal 112 to produce a corresponding second portion of the wireless output 122 transmitted from the second window region 610-2; and so on. Each subsequent window region in a corresponding stack contributes to modification of the receive portion of the wireless signal 112 (electromagnetic signal).

As further discussed herein, controlling the phase and amplitude of different window regions (e.g. different meta-surface cells) enables control of the wireless output 122 in different directions. In other words, controlling the phases of the individual portion of energy outputted from a respective window region (each of which acts a controllable RF source) enables the tuner device 120 to direct the wireless output in any suitable angular direction (e.g., up/down and/or left/right with respect to the z axis). In one embodiment, the tuner device 120 supports angular steering of the wireless output in a range between −70 and +70 degrees with respect to the Z-axis, although different embodiments can be configured to support any suitable angular control.

Figure 7:
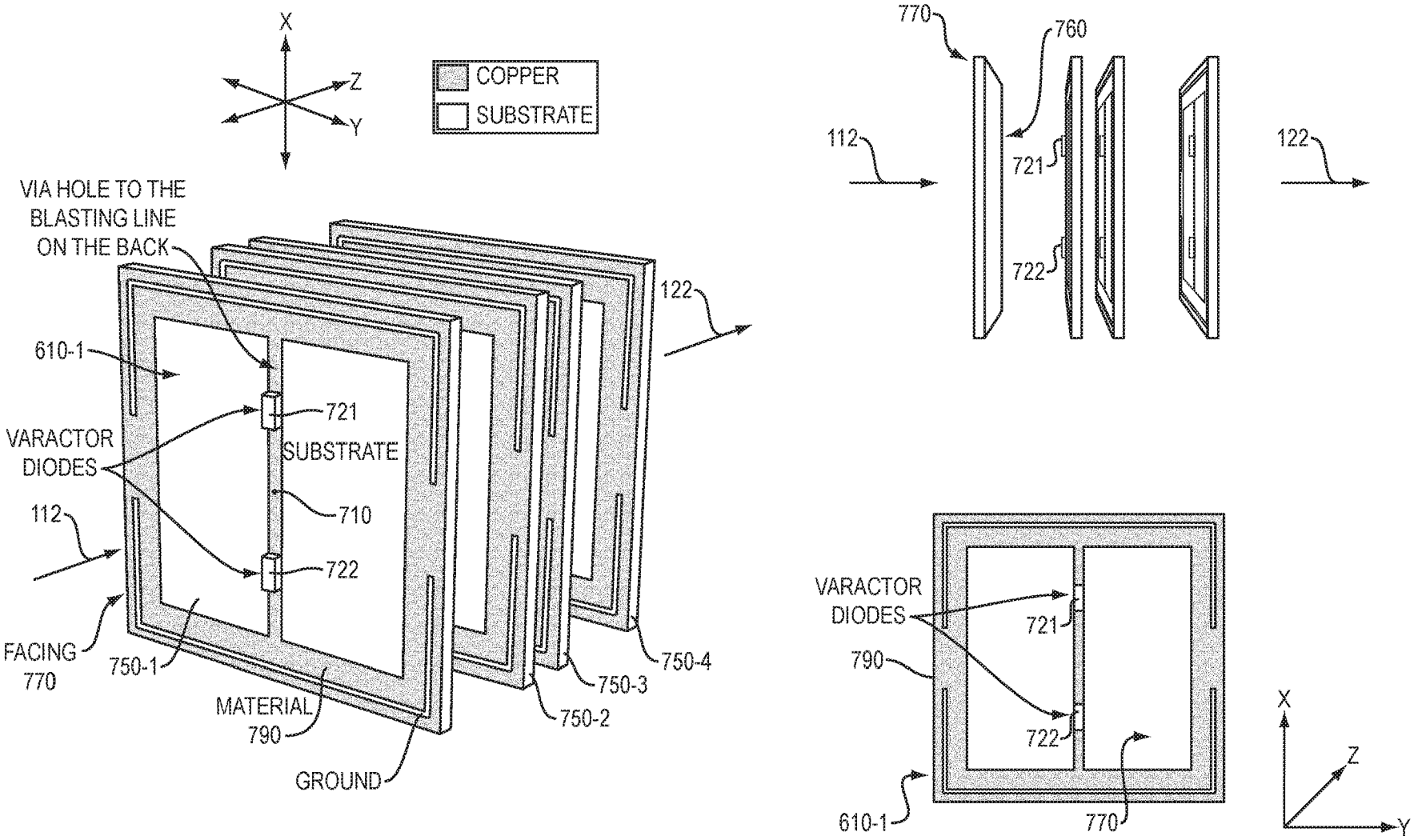
FIG. 7 is an example diagram illustrating details of a front side of a window region (i.e. the tunable radiating aperture) and a stack of multiple window regions according to embodiments herein.

An example of controlling the window regions 610 is further shown in FIG. 7.

FIG. 7 is an example diagram illustrating details of a front side of a window region according to embodiments herein.

In this example embodiment, window region 610-1 includes multiple aligned window regions 750 (such as window region 750-1, window region 750-2, etc.) on a respective layer of the tuner device 120. Each window region layer (substrate) is made of a low-loss dielectric material on which a metal material 790 such as copper is deposited to produce an electrically conductive path around a periphery of the respective window region layer as shown. The middle of each window region is free of a metal layer except a respective circuit path including components such as varactor diodes and trace 710 extending to the periphery of the window region. In one embodiment, the periphery (strip of metalized layer) of the respective window region layer is connected to DC ground. The center of the circuit path or trace 710 is driven by a control voltage provided by the controller 140 as a bias.

Figure 9:
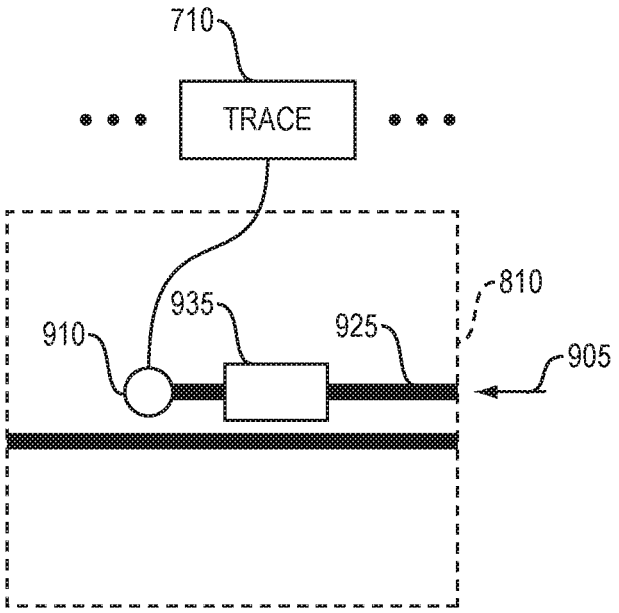
FIG. 9 is an example diagram illustrating a control circuit implementation associated with a corresponding window region according to embodiments herein.

With reference to FIG. 9, to avoid the leakage of RF energy from the DC circuit path (such as trace 710 in a window region) back to the controller 140, embodiments herein include a respective RF choke circuit 935 (or alternatively one or more components such as inductors and/or resistors) placed between the through-hole via 910 (coupled to trace 710 on an opposite face of the window region) and trace 925 extending back to the controller 140. Via a control signal (applied voltage) generated by the controller 140 to trace 925 for a corresponding window region 610-1, the controller 140 controls the tuning of window region 610-1. That is, the controller 140 generates a control signal 905 that is conveyed over trace 925, through choke 925 and through-hole via 910 to the trace 710 coupled to varactors (or other suitable components) on opposite facing of the window region. In a manner as previously discussed, the applied voltage associated with control signal 905 tunes the window region 610-1 to modify the phase and/or amplitude of an inputted portion of energy from the wireless signal 112. In a similar manner, via generation of different applied voltages, the controller 140 controls each of the window regions in the tuner device 120.

Referring again to FIG. 7, as further shown, each window region layer 750 (such as 750-1, 750-2, 750-3, etc.) includes a respective one or more tuning components such as varactor diodes 721 and 722. The components 721 and 722 in window region 750-1 (such as diodes 721 and 722) are connected in parallel and the controller drives the trace 710 with the drive signal. As previously discussed, each of the other window regions 750-2, 750-3, 750-4, etc., is fabricated and patterned in a similar manner as window region 750-1.

Thus, during operation, the controller 140 produces a respective drive signal and applies it to the trace 710 (part of the circuit path) disposed on the surface (facing 770) of the respective window region 750-1. The controller 140 drives the trace 710 with an appropriate voltage (such as a DC voltage, or AC voltage) to control the respective capacitance associated with diode components 721 and 722 and corresponding window region 750-1, resulting in control of a resonance frequency associated with the respective window region 750-1. The controller 140 drives each window region of the tuner device 120 in a similar manner to control resonant frequencies of the multiple window regions.

In one embodiment, control of the resonance frequency (such as via application of a DC voltage) associated with each of the window regions 750 (for a given window region) enables the controller 140 to control a respective amplitude and phase associated with the corresponding portion of the wireless output 122 passing through that window region. Thus, each window region (e.g. each meta-surface unit cell) is individually controllable. As previously discussed, stacks of aligned window regions from layer to layer in the tuner device 120 provide overall control of electromagnetic energy passing through the window region. As the electromagnetic signal passes through the window region in a stack, the respective window region modifies attributes of the passing electromagnetic signal.

Individual control of each of the different stacks of window regions enables beamforming of the original receives wireless signal 112.

In other words, controlling attributes of electromagnetic signal passing through each respective window region (and corresponding window region layers) enables the controller 140 to control the amplitude and/or phase of different portions wireless output 122 to control an amplitude and steer the respective wireless output 122 (electromagnetic signal) in any angular direction with respect to the z-axis (e.g., axis in which the window regions 750 are aligned).

Note that the tuner device 120 is bidirectional/reciprocal in operation. For example, in a reverse direction, the tuner device 120 can be tuned to receive a signal from a desired direction in which case the stacks of window regions modify attributes of received portions of electromagnetic energy in the respective window regions. The source 102 (or other suitable resource) can be configured to perform further processing of the received signals (such as to retrieve any data, or apply other processing, etc.).

Figure 8:
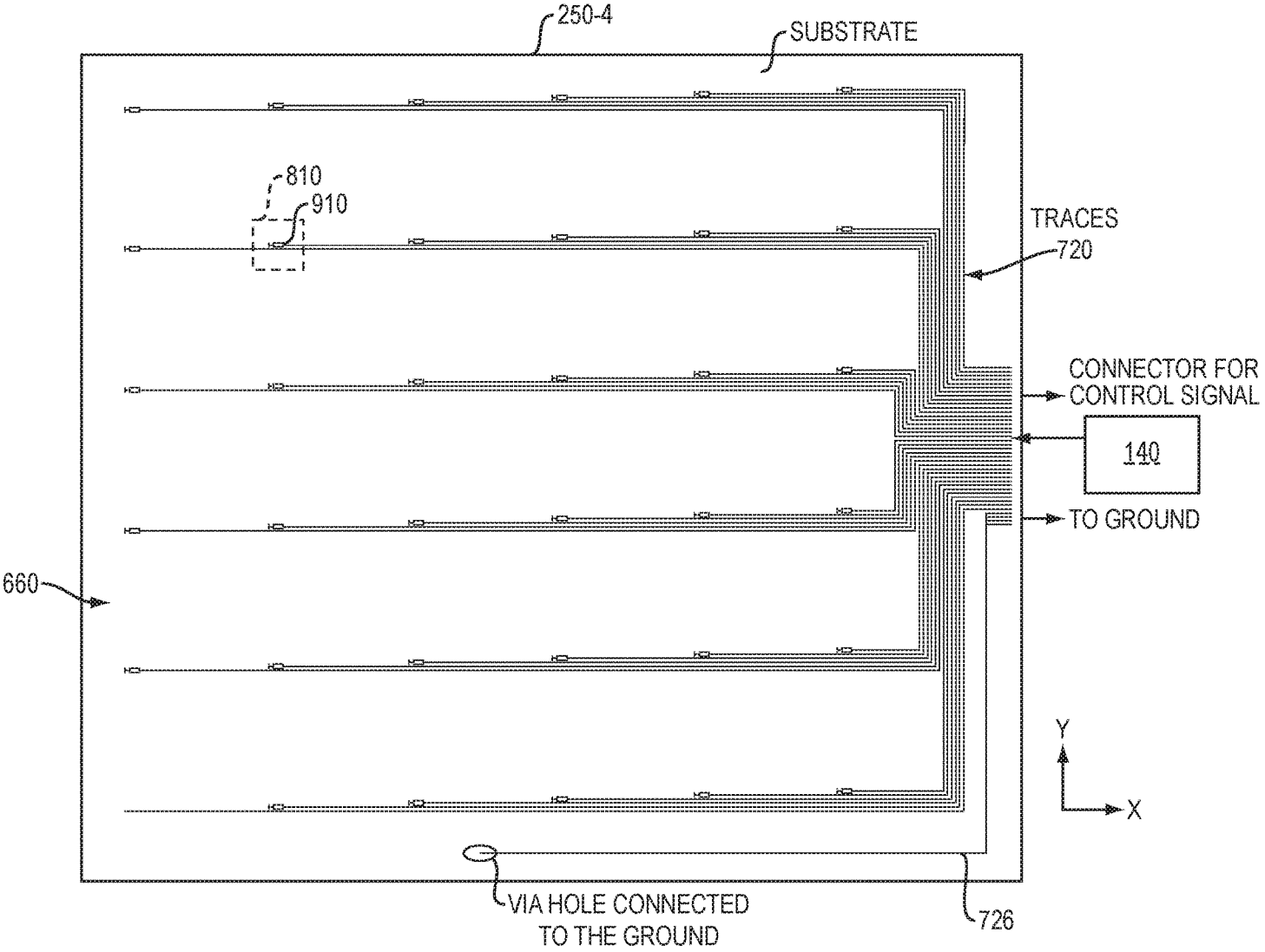
FIG. 8 is an example diagram illustrating a backside of a window region (i.e. the tunable radiating aperture) on a meta-surface layer according to embodiments herein.

FIG. 8 is an example diagram illustrating a backside of a window region according to embodiments herein.

As shown, traces 720 disposed on facing 660 of the layer 250-4 (layer of window regions) enable the controller 140 to deliver appropriate voltages (such as DC control signals) to each respective window region (such as window region 610-1, 610-2, 610-3, etc.) In each respective layer to drive corresponding varactor diodes in each window region in the different layers.

Facing 660 (backside of example layer 250-4) further includes trace 726 to form a DC ground path to the periphery metallic material of each respective window region associated with the tuner device 110. Each of the tunable layers of window regions (through which portions of electromagnetic signals pass) in the tuner device 120 is fabricated and operated in a similar manner.

Figure 10:
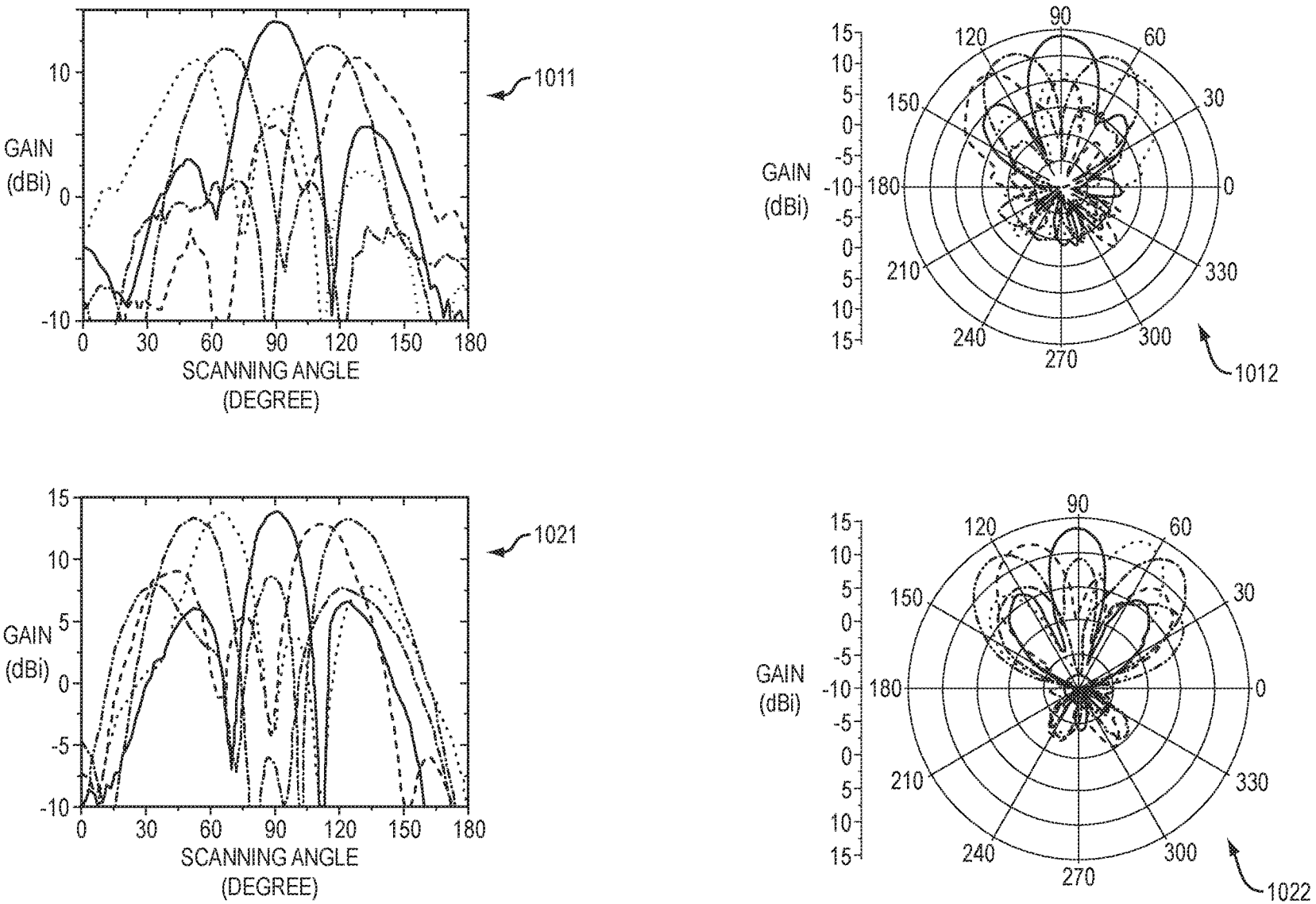
FIG. 10 is an example diagram illustrating measured radiation patterns with two-dimensionally electrically steered beams according to embodiments herein.

FIG. 10 is an example diagram illustrating different possible radiation patterns according to embodiments herein.

In this example embodiment, graph 1011 and graph 1012 indicate beam-steering of the tuner device 120 in the E-plane. Graph 1021 and graph 1022 indicate beam-steering of the tuner device 120 in the H-plane. Thus, embodiments herein support two-dimensional beam steering, beam-forming, etc.

As previously discussed, the array of window regions associated with the tuner device 120 enable the controller 140 to control an amplitude and phase associated with each received portion of wireless signal 112 to steer the wireless output 122 in any desired direction.

By way of non-limiting example, example performances associated with one example embodiment of the tuner device 120, the E-plane and the H-plane are as follows:

E-Plane Performance:
- Gain=12 dBi to 14 dBi;
- Average side lobe level=−8 dB;
- Scanning coverage −40 to 40 degree;
- Average back to front ratio: −13 dB.

H-Plane Performance:
- Gain=12.5 dBi to 14 dBi;
- Average side lobe level=−8 dB;
- Scanning coverage −40 to 40 degree;
- Average back to front ratio: −15 dB.

Note that these values can vary depending on the embodiment.

FIG. 11A is an example side view diagram illustrating a stack including window regions and corresponding multiple matching metalized layers (such as pads, patches, etc.) according to embodiments herein.

In this example embodiment, the stack 1101 of aligned window regions 750 in the tuner device 120 also includes one or more passive metalized layers of material such as layer of material 1150-1 (such as a pad, patch, etc.), layer of material 1150-2 (such as a pad, patch, etc.).

During operation, the tuner device 110 outputs the portion of energy 112-1 towards stack 1101 of aligned window regions 750 and metalized layers 1150. As previously discussed, the controller 140 actively controls the window region 750 (window region 750-1, window region 750-2, window region 750-3, etc.).

In this example embodiment, stack 1101 further includes metallized layer of material 1150-1 and metallized layer of material 1150-2. Based on the control of the window regions 750, and presence of the metallized layers of material 1150, the stack 1101 controls attributes (such as phase, gain, etc.) of the respective portion of the input signal 112-1 (electromagnetic energy) to produce the output signal 122-1.

Presence of the one or more passive layers 1150 (such as pads, patches, etc., of material) reduces a number of active window regions 750 needed in the stack to achieve the same or better level of control attributes (such as phase, amplitude, etc.) of the received portion of the input signal 112-1 that passes through stack 1101 and is outputted as a corresponding portion of the wireless output 122-1. Accordingly, presence of the one or more passive layers 1150 reduces a complexity in controlling and manufacturing associated with the tuner device 120.

Note that this example embodiment illustrates modification of only a portion of the input signal 112 (such as portion 112-1 to produce wireless output 122-1). As previously discussed, the tuner device 120 can include any number of stacks that are independently tuned to provide appropriate overall output signal 122.

In one embodiment, presence of one or more metallized layers of material 1150 (such as pads, patches, etc.) decreases the number of tunable layers from four to three at frequencies of 24 GHz (or other suitable value) compared to the previous embodiments without the metalized layers 1150 operating at lower frequencies.

Additionally, the example tuner device 120 including the active layer sandwiched between respective passive metalized regions enables full phase change of 2 PI (i.e. 360-degree phase coverage). Additionally, the optional passive matching layers enhances overall performance and stability of the tuner device 120. With respect to performance, in one non-limiting example embodiment, the tuner device 120 as described herein enables making negative 60 degrees to positive 60 degrees beam scanning. In a similar manner as previously discussed, the low-profile and compactness of the tuner device 120 make it desirable for installation in many different types of applications.

FIG. 11B is an example top view diagram illustrating window regions and corresponding multiple matching metalized layers according to embodiments herein.

For illustrative purposes, this non-operational view of components in the stack 1101 shows an onward or top view of the active regions 750-1, 750-2, etc., as well as passive operating metalized layers of material such as layer of material 1150-1 (such as a pad, patch, etc.), layer of material 1150-2 (such as a pad, patch, etc.). Note that the size, thickness, dimensions of the layers of material 1150 varies depending on the embodiment and desired signal tuning.

Figure 12:
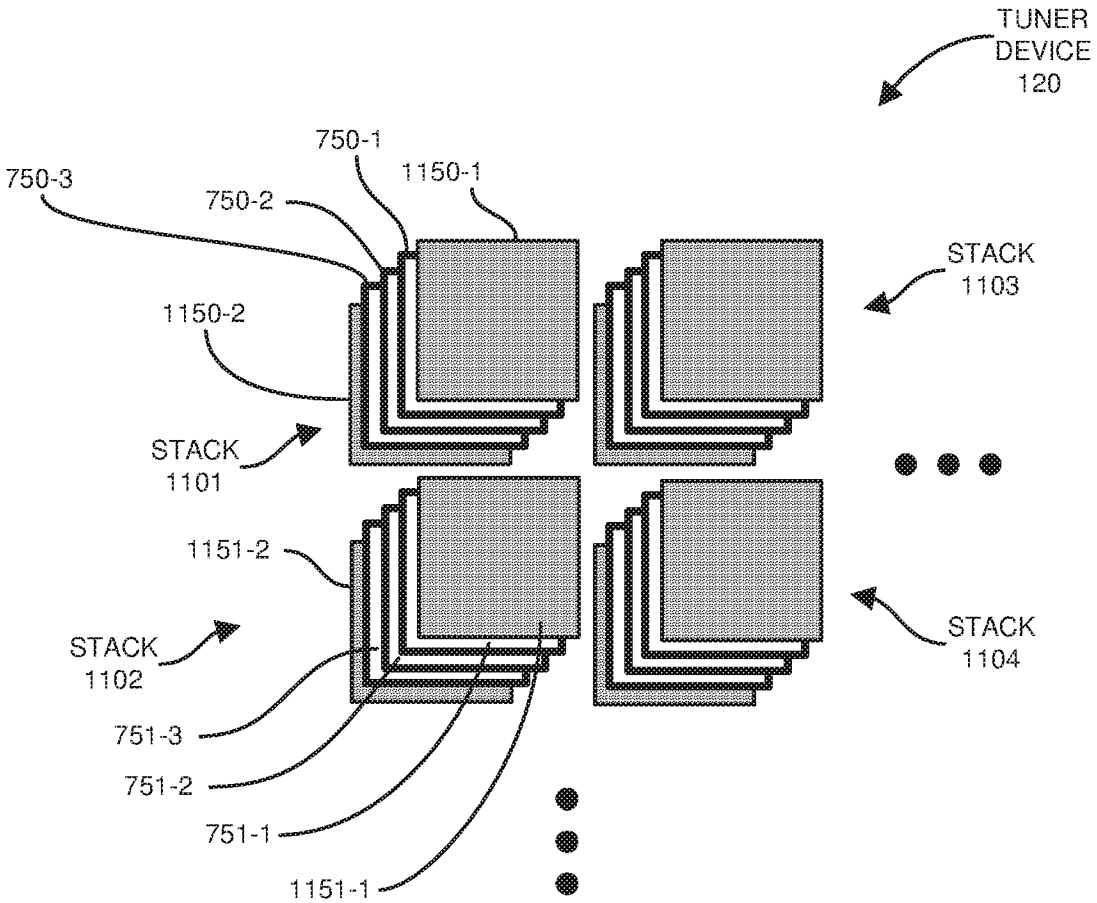
FIG. 12 is an example diagram illustrating arrays of stacks of window regions and matching metalized layers (of pad regions) according to embodiments herein

FIG. 12 is an example diagram illustrating arrays of stacks of window regions and matching metalized layers according to embodiments herein As previously discussed, each stack of components (such as comprising one or more window regions 750, one or more metalized layers of material 1150) in the tuner device 120 controls a different portion of passing energy associated with received wireless signal 112.

In this example embodiment, the stack 1101 of the tuner device 120 includes: i) a first stack 1101 of aligned window regions 750-1, 750-2, and 750-3 operable to receive a first portion of energy from the wireless signal 112 emitted from the source 110, and ii) a second stack 1102 of aligned window regions 751-1, 751-2, and 751-3 operable to receive a second portion of energy from the wireless signal 112 emitted from the source 110, iii) a third stack 1103 of aligned window regions operable to receive a third portion of energy from the wireless signal 112 emitted from the source 110, and so on.

As previously discussed, each of the aligned window regions 750 in the first stack 1101 is tunable to adjust phase/amplitude associated with the first portion of energy passing through the first stack 1101; each of the aligned window regions 751 in the second stack 1102 is tunable to adjust phase/amplitude associated with the second portion of energy passing through the first stack 1102; and so on.

As previously discussed, stack 1101 can be configured to include a first passive metalized material layer 1150-1 disposed at a first axial end of the first stack 1101; a second passive metalized material layer 1150-2 of the first stack 1101 is disposed at a second axial end of the first stack 1101 opposite the first axial end of the first stack 1101. As further shown, stack 1102 can be configured to include a second passive metalized material layer 1151-1 disposed at a first axial end of the second stack 1102; a second passive metalized material layer 1151-2 of the second stack 1102 is disposed at a second axial end of the second stack 1102 opposite the first axial end of the second stack 1101, and so on.

Note again that the first passive metalized regions 1150-1, 1151-1, etc., reside on a first substrate (such as layer 250-1 of the tuner device 120); the window regions 750-1, 751-1, etc., reside on a second substrate (such as layer 250-2 of the tuner device 120); the window regions 750-2, 751-2, etc., reside on a third substrate (such as layer 250-3 of the tuner device 120); the window regions 750-3, 751-3, etc., reside on a fourth substrate (such as layer 250-4 of the tuner device 120); second passive metalized regions 1150-2, 1151-2, etc., reside on a fifth substrate (such as layer 250-5 of the tuner device 120).

As previously discussed, dimensions of each of the optional one or more passive metalized regions 1150 can be designed to control passing of energy as well.

Figure 13:
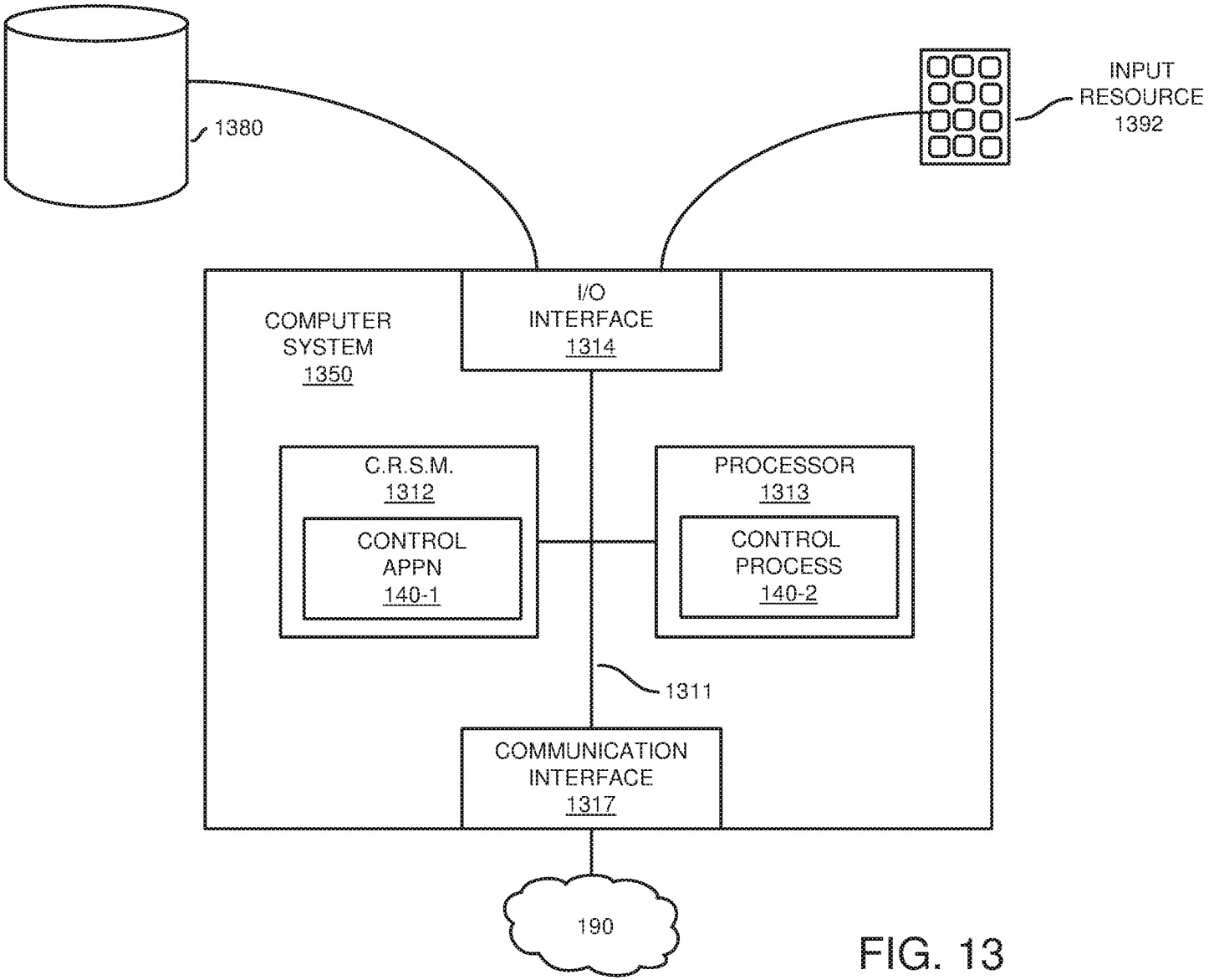
FIG. 13 is an example diagram illustrating example computer architecture operable to execute one or more operations according to embodiments herein.

FIG. 13 is an example block diagram of a computer system for implementing any of the operations as previously discussed according to embodiments herein.

Any of the resources (such as controller 140, etc.) as discussed herein can be configured to include computer processor hardware and/or corresponding executable (software) instructions to carry out the different operations as discussed herein.

As shown, computer system 1350 of the present example includes an interconnect 1311 coupling computer readable storage media 1312 such as a non-transitory type of media (which can be any suitable type of hardware storage medium in which digital information can be stored and retrieved), a processor 1313 (computer processor hardware), I/O interface 1314, and a communications interface 1317.

I/O interface(s) 1314 supports connectivity to repository 1380 and input resource 1392.

Computer readable storage medium 1312 can be any hardware storage device such as memory, optical storage, hard drive, floppy disk, etc. In one embodiment, the computer readable storage medium 1312 stores instructions and/or data.

As shown, computer readable storage media 1312 can be encoded with management application 140-1 (e.g., including instructions) to carry out any of the operations as discussed herein.

During operation of one embodiment, processor 1313 accesses computer readable storage media 1312 via the use of interconnect 1311 in order to launch, run, execute, interpret or otherwise perform the instructions in in the management application 140-1 stored on computer readable storage medium 1312. Execution of the control application 140-1 produces control process 140-2 to carry out any of the operations and/or processes as discussed herein.

Those skilled in the art will understand that the computer system 1350 can include other processes and/or software and hardware components, such as an operating system that controls allocation and use of hardware resources to execute management application 140-1.

In accordance with different embodiments, note that computer system may reside in any of various types of devices, including, but not limited to, a mobile computer, wireless communication device, gateway resource, communication management resource, a personal computer system, a wireless device, a wireless access point, a base station, phone device, desktop computer, laptop, notebook, netbook computer, mainframe computer system, handheld computer, workstation, network computer, application server, storage device, a consumer electronics device such as a camera, camcorder, set top box, mobile device, video game console, handheld video game device, a peripheral device such as a switch, modem, router, set-top box, content management device, handheld remote control device, any type of computing or electronic device, etc. The computer system 850 may reside at any location or can be included in any suitable resource in any network environment to implement functionality as discussed herein.

Functionality supported by the different resources will now be discussed via flowchart in FIG. 14. Note that the steps in the flowcharts below can be executed in any suitable order.

Figure 14:
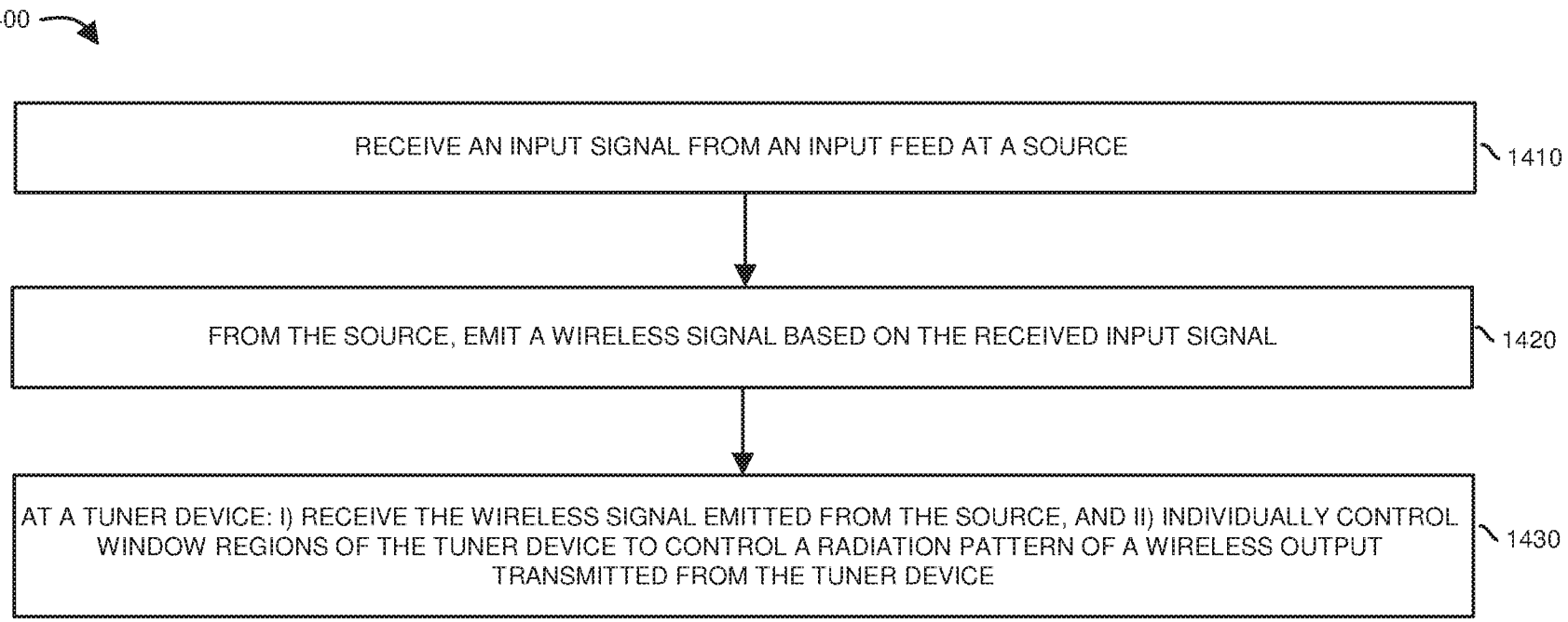
FIG. 14 is an example diagram illustrating a method according to embodiments herein.

FIG. 14 is a flowchart 1400 illustrating an example method according to embodiments herein. Note that there will be some overlap with respect to concepts as discussed above.

In processing operation 1410, the source 110 receives an input signal 105 from source 102.

In processing operation 1420, the source 110 emits a wireless signal 112 to the tuner device 120.

In processing operation 1430, the tuner device 120: i) receives the wireless signal 112 emitted from the source 110, and ii) the controller 140 individually controls window regions of the tuner device 120 to control a radiation pattern of a wireless output transmitted from the tuner device.

Figure 15:
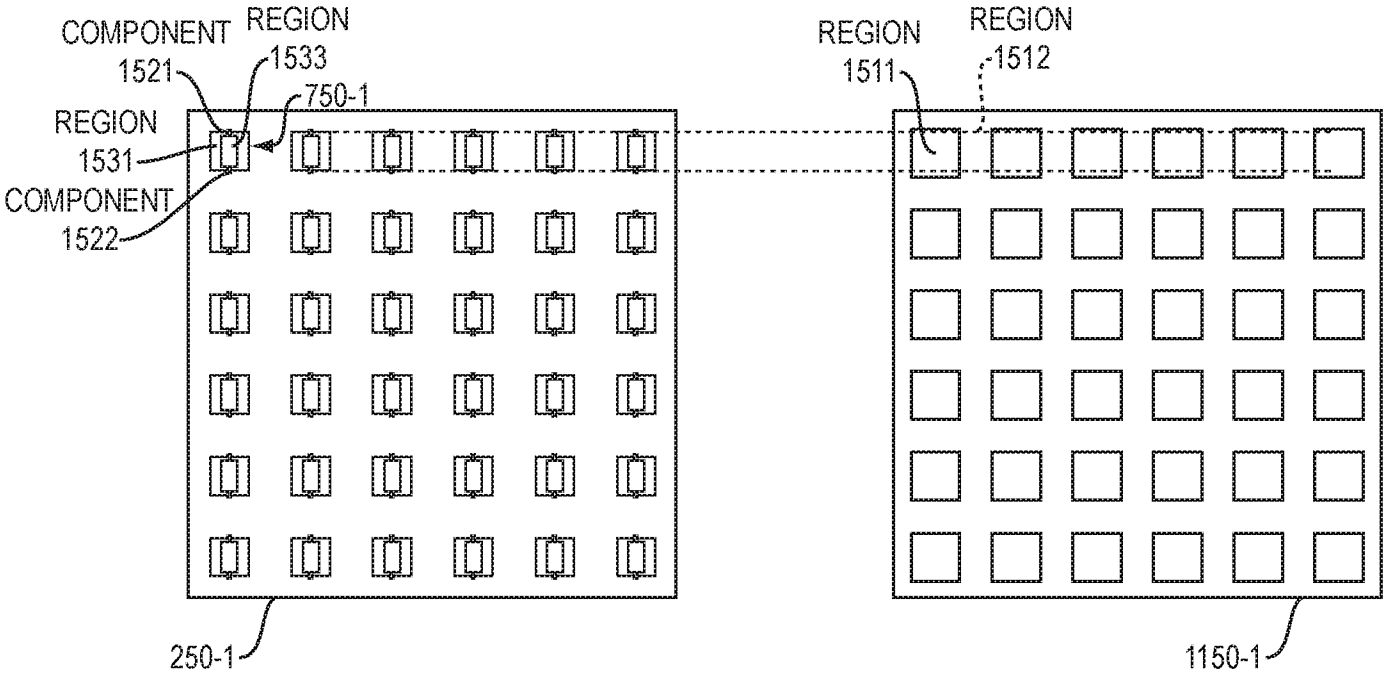
FIG. 15 is an example top view diagram illustrating laid out active window regions on a first substrate and corresponding multiple matching metalized layers pads (regions) on a second substrate according to embodiments herein.

FIG. 15 is an example top view diagram illustrating laid out window regions and corresponding multiple matching metalized layers pads or patches on a substrate according to embodiments herein.

In this example embodiment, the example layer 250-1 (active window regions) includes window region 750-1. Region 1532 (darker shaded region, coupled to a ground reference) represents a metal layer disposed on substrate 250-1. Region 1533 (metal pad driven with a control signal, such as a voltage signal) resides in the middle of electromagnetic transmissive window region 750-1. Component 1521 (such as a first varactor or other suitable resource) provides coupling from region 1533 to region 1532. Component 1522 (such as a second varactor or other suitable resource) provides coupling from region 1533 to region 1532 as well. Thus the components 1522 and 1523 are connected in parallel to ground. Controller 140 drives the region 1533 with a respective voltage signal to the corresponding window region 750-1.

Each window region on layer 250-1 is configured and controlled in a similar manner.

Example layer 1150-1 (passive layer of pads or metal regions) includes metalized regions 1511 (darker regions) as well as electromagnetic transparent regions 1512.

Figure 16:
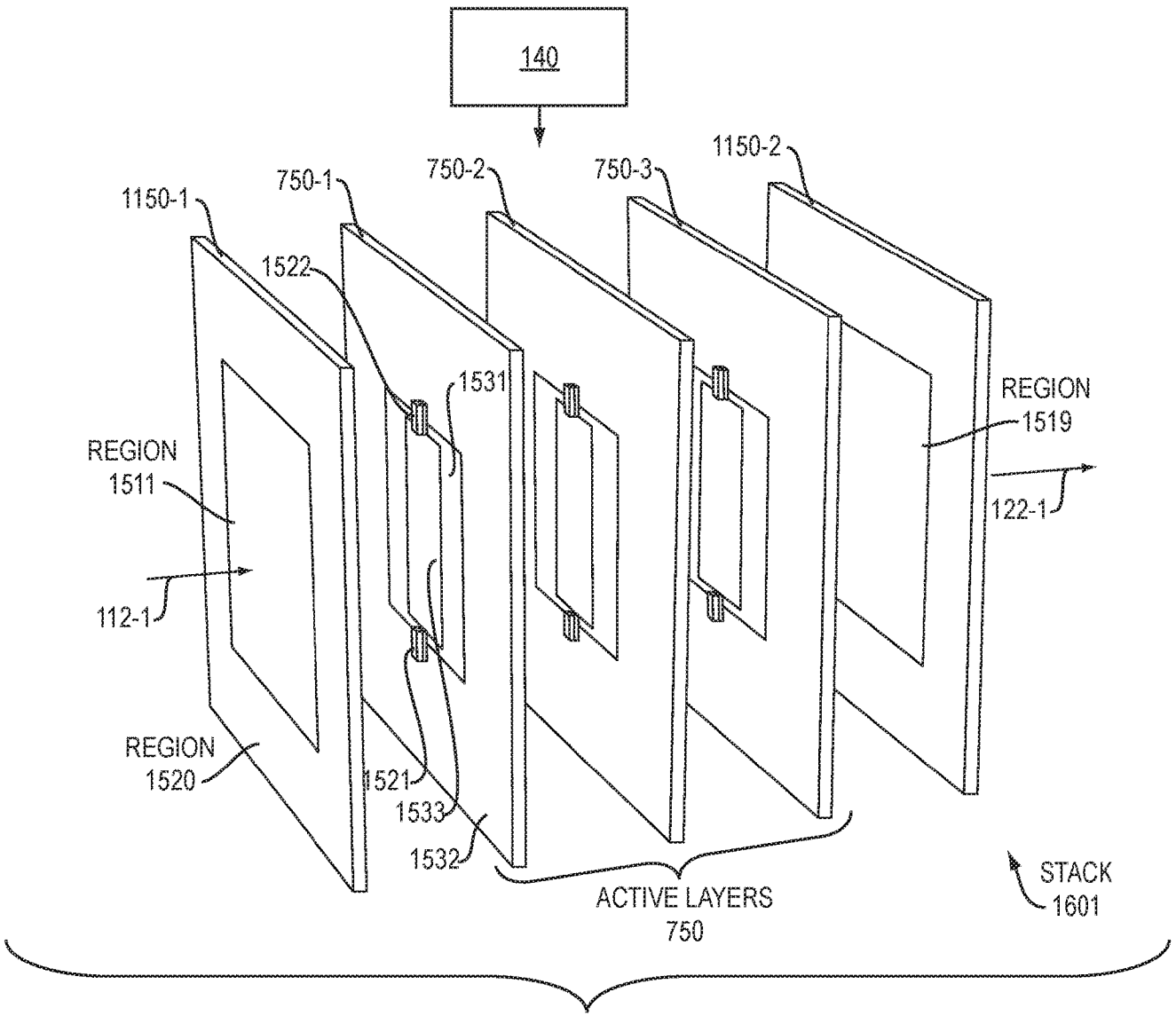
FIG. 16 is an example side view diagram illustrating a stack including (active) window regions and corresponding multiple matching (passive) metalized regions according to embodiments herein.

FIG. 16 is an example side view diagram illustrating a stack including window regions and corresponding multiple matching metalized pads according to embodiments herein.

In this example embodiment, the stack 1601 includes region 1511 (such as metal pad on substrate layer 1150-1), window region 750-1, window region 750-2, window region 750-3, and region 1519 (such as a metal pad on substrate layer 1150-2).

As previously discussed, controller 140 controls settings of active layer 750 via application of a respective voltage to each of the center regions (such as region 1533 and the like) of a respective window 750.

Stack 1601 receives a portion of a wireless signal 112-1. The combination of the different components in the stack 1601 operate to modify one or more attributes associated with the received wireless signal 112-1 to produce the wireless output 122-1.

Each stack operates to modify a respective received wireless signal to produce a wireless output in a similar manner as described herein.

Figure 17:
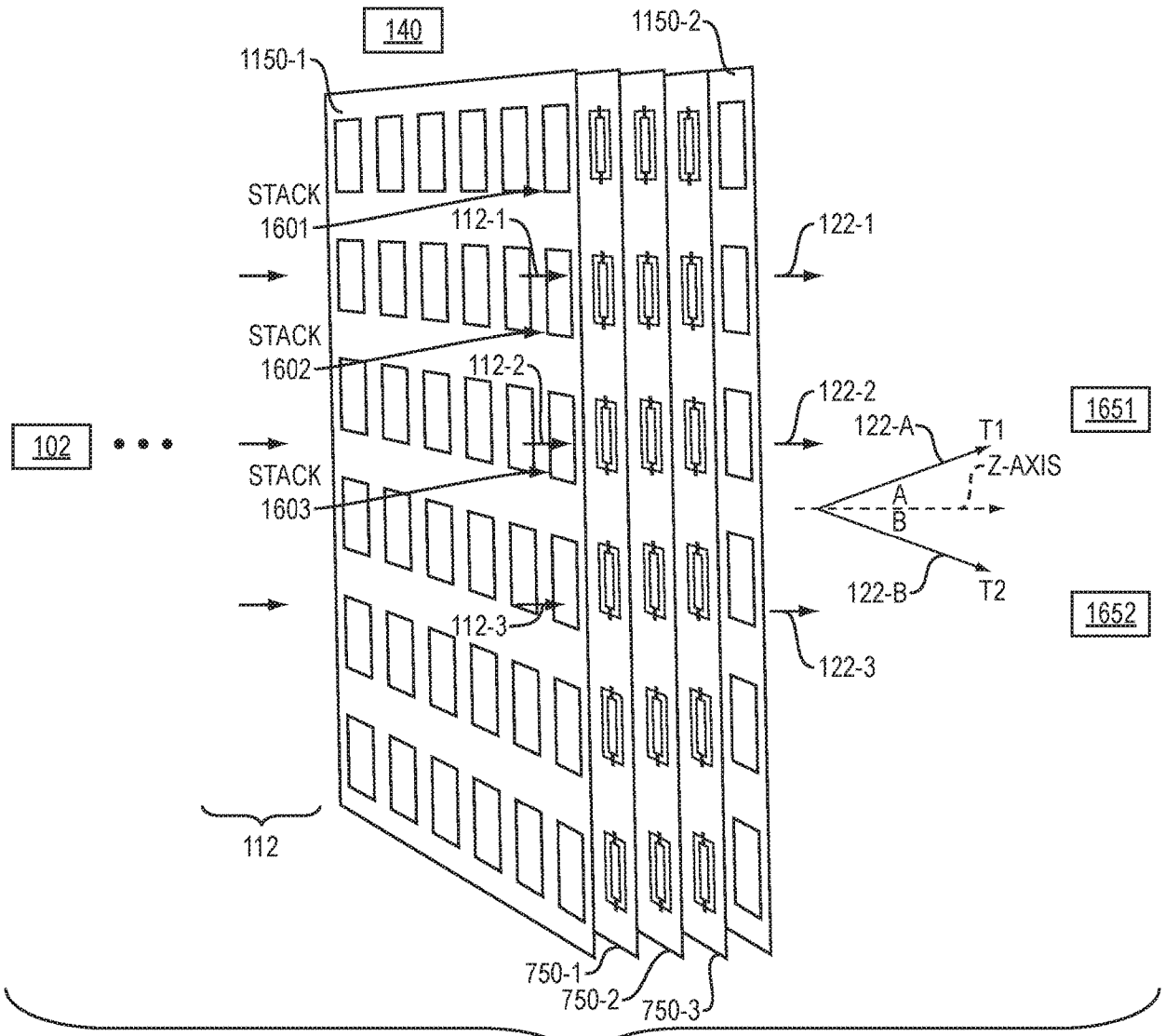
FIG. 17 is an example diagram illustrating arrays of stacks of window regions and matching metalized layers of pads operable to communicate data from a source and tuner device to different communication devices according to embodiments herein.

FIG. 17 is an example diagram illustrating arrays of stacks of window regions and matching metalized layers of pads according to embodiments herein.

In this example embodiment, the source 102 initiates generation of the wireless signal inputted to the tuner device 120 in any suitable manner such as previously discussed. Tuner device 120 receives the wireless signal 112.

In timeframe T1, the controller 140 individually tunes each of the stacks 1601, 1602, 1603, etc., to communicate wireless output 122-A (such as wireless output 122 and at angle A including first data) to the communication device 1651 in timeframe T1. In timeframe T2, the controller 140 individually tunes each of the stacks 1601, 1602, 1603, etc., to communicate wireless output 122-B (such as at angle B including second data) to the communication device 1652 in timeframe T2.

Further in this example embodiment, stack 1601 of tuner device 120 receives and modifies one or more attributes associated with wireless signal 112-1 (portion of wireless signal 112) depending on respective settings of corresponding active window regions in stack 1601 as driven by the controller 140. Via modification (such as phase or other attribute modification) of the inputted wireless signal 112-1 of the passing wireless (electromagnetic) signal (i.e., wireless output portion 112-1), the stack 1601 produces the corresponding output signal 122-1. Thus, stack 1601 and corresponding first window regions control a phase of the first portion of the received wireless signal 112-1 to produce a corresponding first portion of the wireless output 122-1.

Stack 1602 of tuner device 120 receives and modifies one or more attributes associated with received wireless signal 112-2 depending on respective settings of corresponding active window regions in stack 1602 as driven by the controller 140. Via modification (such as phase modification) of the inputted wireless signal 112-2 of the passing wireless signal (portion of wireless signal 112-2), the stack 1602 produces the output signal 122-2 (portion of wireless output 122). Thus, stack 1602 and corresponding second window regions control a phase of the second portion of the received wireless signal 112-2 to produce a corresponding second portion of the wireless output 122-2.

Stack 1603 of tuner device 120 receives and modifies one or more attributes associated with wireless signal 112-3 depending on respective settings of corresponding window regions in stack 1603 as driven by the controller 140. Via modification (such as phase modification) of the inputted wireless signal 112-3 of the passing wireless signal (portion of wireless signal 112-3), the stack 1603 produces the output signal 122-3. Thus, stack 1603 and corresponding third window regions control a phase of the third portion of the received wireless signal 112-3 to produce a corresponding second portion of the wireless output 122-3.

Accordingly, the controller 140 individually tunes each of the multiple window regions to produce a wireless output (122-A, 122-B, etc.) from the received wireless signal 112 at different times; the tuned window regions modify the different respective portions of the respective wireless signal (112-1, 112-2, 112-3, etc.) passing therethrough.

Collectively, the modification to the inputted wireless signal 112 via the tuner device 120 and corresponding stacks of window regions steers (at angle A with respect to z-axis) the wireless signal 122 (wireless output 122-A and corresponding data payload) to the communication device 1651 at timeframe T1; the modification to the inputted wireless signal 112 via the tuner device 120 steers (at angle B with respect to z-axis) the wireless signal (output signal 122-B and corresponding data payload) to the communication device 1652 at timeframe T2.

Thus, in this example embodiment, the controller 140 controls steering of the wireless signals 122-A and 122-B based on tuning of the respective window regions of the tuner device 120 at different times to convey data/RF power to devices at different spatial locations.

Accordingly, embodiments herein include implementing the controller 140 and corresponding variably tuning of settings of the multiple individually controlled window regions to variably steer (or beam form to a desired shape)

the wireless output 122 (such as wireless output 122-A, 122-B, etc. in different desired directions at different times.

Figure 18:
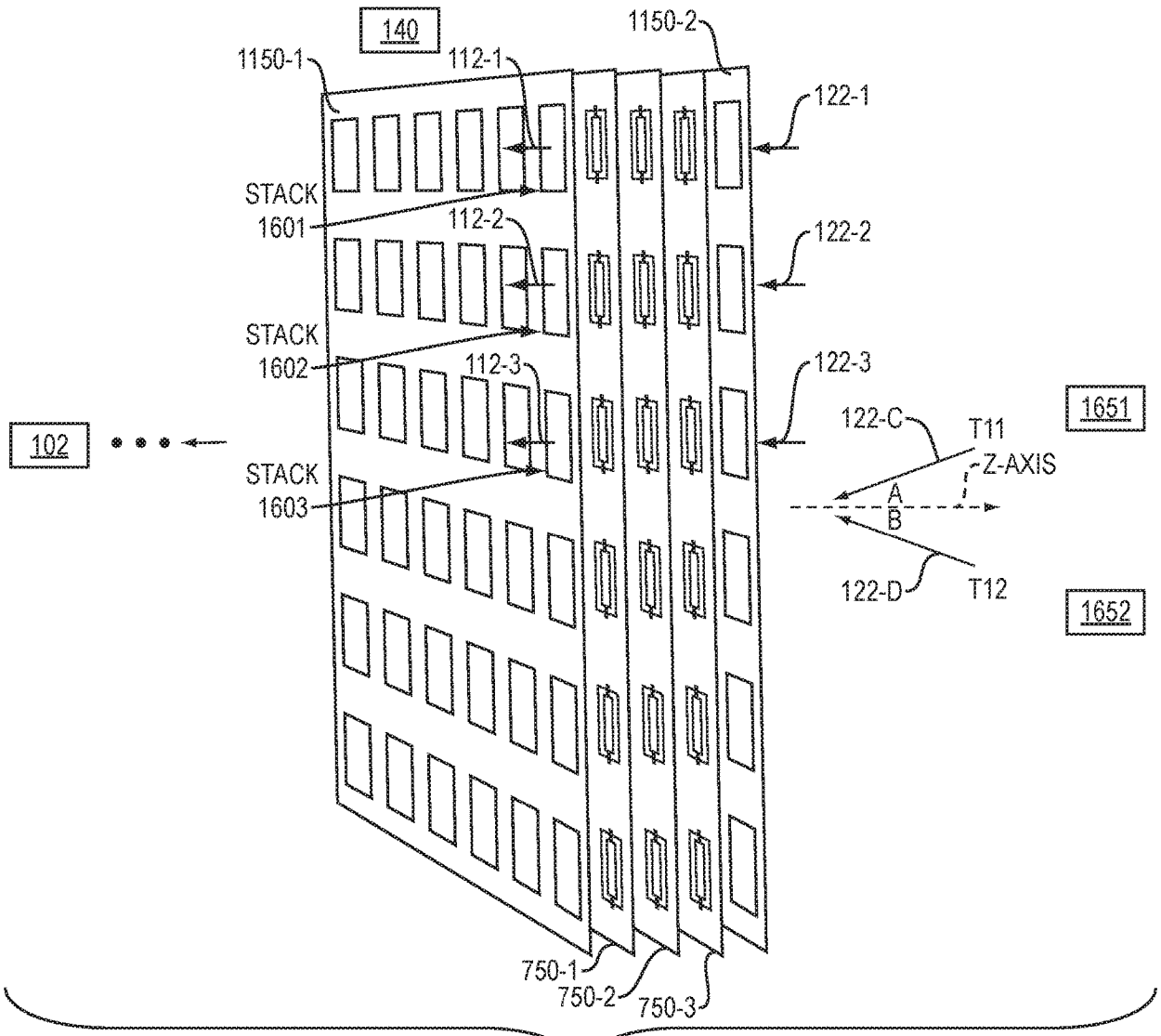
FIG. 18 is an example diagram illustrating arrays of stacks of window regions and matching metalized layers of pads operable to receive wireless signals from multiple communication devices communicated to a source according to embodiments herein.

FIG. 18 is an example diagram illustrating arrays of stacks of window regions and matching metalized layers of pads according to embodiments herein.

In this example embodiment, the source 102 receives data from multiple communication devices 1651 and 1652.

In timeframe T11, the communication device 1561 communicates wireless signal 122-C (electromagnetic signal) at angle A (with respect to z-axis) to the tuner device 120. In timeframe T12, via beam-steering, or beam-forming, the controller 140 individually tunes each of the stacks 1601, 1602, 1603, etc., to receive wireless signal 122-D (such as including fourth data) from the communication device 1652 from angle B (with respect to Z-axis).

Further in this example embodiment, stack 1601 of tuner device 120 receives and modifies one or more attributes associated with received wireless signal 122-C (portion of wireless signal 122-1) depending on respective settings of corresponding window regions in stack 1601 as driven by the controller 140. Via modification (such as phase modification) of the inputted wireless signal 122-1, the stack 1601 produces the output signal 112-1. Thus, stack 1601 and corresponding first window regions control a phase of the first portion of the received wireless signal 122-1 to produce a corresponding first portion of the wireless output 112-1.

Stack 1602 of tuner device 120 receives and modifies one or more attributes associated with received wireless signal 122-C (portion of wireless signal 122-2) depending on respective settings of corresponding window regions in stack 1602 as driven by the controller 140. Via modification (such as phase modification) of the inputted wireless signal 122-2, the stack 1602 produces the output signal 112-2. Thus, stack 1602 and corresponding second window regions control a phase of the second portion of the received wireless signal 122-2 to produce a corresponding second portion of the wireless output 112-2.

Stack 1603 of tuner device 120 receives and modifies one or more attributes associated with received wireless signal 122-C (portion of wireless signal 122-3) depending on respective settings of corresponding window regions in stack 1603 as driven by the controller 140. Via modification (such as phase modification) of the inputted wireless signal 122-3, the stack 1603 produces the output signal 112-3. Thus, stack 1603 and corresponding third window regions control a phase of the third portion of the received wireless signal 122-3 to produce a corresponding third portion of the wireless output 112-3.

In one embodiment, each of the wireless signals 112-1, 112-2, 112-3, etc., are redirected along or parallel with the z-axis in a direction towards source 102.

Accordingly, the controller 140 individually tunes each of the multiple window regions to receive a wireless signal (122-C, 122-D, etc.) from the received wireless signal 122 at different times and different angles; the tuned window regions modify the different respective portions of the respective wireless signal (122-1, 122-2, 122-3, etc.) passing therethrough.

Accordingly, the controller 140 variably tunes settings of the multiple individually controlled window regions to receive wireless signals 122-C and 122-D from different angles at different times.

Figure 19:
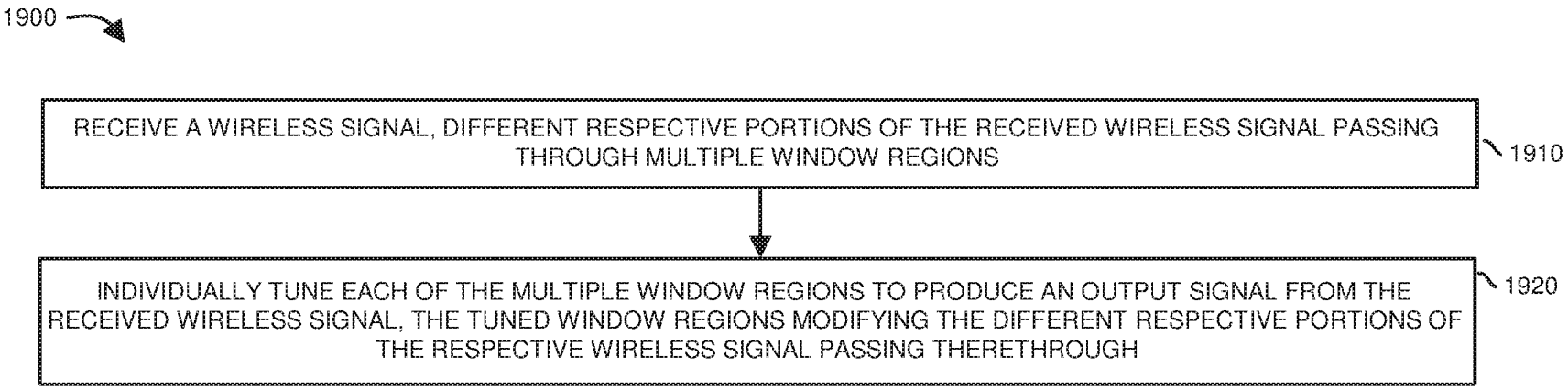
FIG. 19 is an example diagram illustrating a method according to embodiments herein.

FIG. 19 is a flowchart 1900 illustrating an example method according to embodiments herein. Note that there will be some overlap with respect to concepts as discussed above.

In processing operation 1910, the system 100 receiving an input signal from an input feed at a source.

In processing operation 1920, source emits a wireless signal based on the received input signal.

In processing operation 1930, the tuner device: i) receives the wireless signal emitted from the source, and ii) individually controls window regions of the tuner device to control a radiation pattern of a wireless output transmitted from the tuner device.

Note again that techniques as discussed herein are well suited for use in applications supporting dynamic control of a radiation pattern. However, it should be noted that embodiments herein are not limited to use in such applications and that the techniques discussed herein are well suited for other applications as well.

Based on the description set forth herein, numerous specific details have been set forth to provide a thorough understanding of claimed subject matter. However, it will be understood by those skilled in the art that claimed subject matter may be practiced without these specific details. In other instances, methods, apparatuses, systems, etc., that would be known by one of ordinary skill have not been described in detail so as not to obscure claimed subject matter. Some portions of the detailed description have been presented in terms of algorithms or symbolic representations of operations on data bits or binary digital signals stored within a computing system memory, such as a computer memory. These algorithmic descriptions or representations are examples of techniques used by those of ordinary skill in the data processing arts to convey the substance of their work to others skilled in the art. An algorithm as described herein, and generally, is considered to be a self-consistent sequence of operations or similar processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has been convenient at times, principally for reasons of common usage, to refer to such signals as bits, data, values, elements, symbols, characters, terms, numbers, numerals or the like. It should be understood, however, that all of these and similar terms are to be associated with appropriate physical quantities and are merely convenient labels.

While this invention has been particularly shown and described with references to preferred embodiments thereof, it will be understood by those skilled in the art that various changes in form and details may be made therein without departing from the spirit and scope of the present application as defined by the appended claims. Such variations are intended to be covered by the scope of this present application. As such, the foregoing description of embodiments of the present application is not intended to be limiting. Rather, any limitations to the invention are presented in the following claims.

We claim:

1. An apparatus comprising:

an input feed to receive an input signal;

a source from which to emit a near field wireless signal based on the received input signal;

a tuner device operable to receive the near field wireless signal emitted from the source to produce a wireless output, the tuner device including multiple individually controlled window regions to control a radiation pattern of the wireless output transmitted from the tuner device;

wherein the tuner device includes: i) a first stack of aligned window regions operable to receive a first portion of energy from the near field wireless signal emitted from the source, and ii) a second stack of aligned window regions operable to receive a second portion of energy from the near field wireless signal emitted from the source;

wherein each of the aligned window regions in the first stack is tunable to adjust a phase associated with the first portion of energy passing through the first stack; and wherein each of the aligned window regions in the second stack is tunable to adjust a phase associated with the second portion of energy passing through the second stack.

2. The apparatus as in claim 1, wherein each of the multiple individually controlled window regions is substantially planar and modifies attributes of a respective received portion of the near field wireless signal to produce a corresponding portion of the output signal.

3. The apparatus as in claim 2, wherein each of the multiple individually controlled window regions includes both passive layers without electrically tunable elements and active layers with electrically tunable elements to receive the near field wireless signal.

4. The apparatus as in claim 1 further comprising:

a controller to control settings of the multiple individually controlled window regions, the controller operable to vary the settings to steer the wireless output in a desired direction.

5. The apparatus as in claim 4, wherein the settings produced by the controller control resonance frequencies associated with the multiple individually controlled window regions.

6. The apparatus as in claim 1, wherein each respective window region of the multiple individually controlled window regions controls radiation of a corresponding incident portion of the near field wireless signal received by the respective window.

7. The apparatus as in claim 1, wherein the multiple individually controlled window regions include a first window region and a second window region.

8. The apparatus as in claim 7, wherein the first window region receives the first portion of the near field wireless signal emitted from the source; and wherein the second window region receives the second portion of the near field wireless signal emitted from the source.

9. The apparatus as in claim 8, wherein the first window region controls a phase and amplitude of the received first portion of the near field wireless signal to produce a corresponding first portion of the wireless output transmitted from the first window region; and wherein the second window region controls a phase and amplitude of the received second portion of the near field wireless signal to produce a corresponding second portion of the wireless output transmitted from the second window region.

10. The apparatus as in claim 9 further comprising:

a controller to control settings of the multiple individually controlled window regions, the controller operable to vary the settings to steer the wireless output in a desired direction.

11. The apparatus as in claim 9, wherein the tuner device includes passive metal layers to increase transmission efficiency of passing the received near field wireless signal through the tuner device, the passive metal layers including a first passive metal layer disposed in the first stack and a second passive metal layer disposed in the second stack.

12. The apparatus as in claim 1 further comprising:

a controller operable to individually control a respective capacitance of each corresponding window region of the window regions, control of the respective capacitance modifying a phase of a portion of the near field wireless signal received in the corresponding window region.

13. The apparatus as in claim 12, wherein the individually controlled window regions include: i) a first set of window regions disposed in a first layer of the tuner device; ii) a second set of window regions disposed in a second layer of the tuner device, the second layer spaced apart from the first layer; and wherein a physical separation between the first layer and the second layer is less than a wavelength of the near field wireless signal.

14. The apparatus as in claim 13, wherein the individually controlled window regions include: iii) a third set of window regions disposed in a third layer of the tuner device, the third layer spaced apart from the second layer; and wherein a physical separation between the second layer and the third layer is different than the physical separation between the first layer and the second layer.

15. The apparatus as in claim 1, wherein the first stack includes a first passive metalized layer of material; and wherein the second stack includes a second passive metalized layer of material.

16. The apparatus as in claim 1, wherein the first stack includes a first set of multiple passive metalized material layers; and wherein the second stack includes a second set of multiple passive metalized material layers.

17. The apparatus as in claim 1, wherein a first passive metal element is disposed at a first axial end of the first stack;

wherein a second passive metal element is disposed at a second axial end of the first stack opposite the first axial end of the first stack;

wherein a third passive metal element is disposed at a first axial end of the second stack; and wherein a fourth passive metal element is disposed at a second axial end of the second stack opposite the first axial end of the second stack.

18. The apparatus as in claim 1, wherein a physical separation between the source and the tuner device is less than a wavelength of the near field wireless signal.

19. The apparatus as in claim 18, wherein the near field wireless signal travels along a Z-axis orthogonal to a planar surface of each of the window regions disposed in an X-Y plane defined by an X-axis and a Y-axis; and wherein a first dimension of each of the window regions in the X-axis is less than the wavelength of the near field wireless signal; and wherein a second dimension of each of the window regions in the Y-axis is less than the wavelength of the near field wireless signal.

20. The apparatus as in claim 1, wherein a physical gap between a surface from which the near field wireless signal is transmitted from the source and a layer of the tuner device including a first set of window regions is less than a wavelength of the near field wireless signal.

21. The apparatus as in claim 1, wherein each of the aligned window regions in the first stack is tunable via a respective circuit path extending through a respective window region to adjust the phase associated with the first portion of energy passing through the first stack; and wherein each of the aligned window regions in the second stack is tunable via a respective circuit path extending through a respective window region to adjust the phase associated with the second portion of energy passing through the second stack.

22. The apparatus as in claim 1, wherein each respective window region of the individually controlled window regions includes a corresponding circuit path extending through the respective window region.

23. The apparatus as in claim 22, wherein the corresponding circuit path separates the respective window region into a first sub-window region and a second sub-window region.

24. The apparatus as in claim 23, wherein a respective voltage applied to a node in the corresponding circuit path controls resonance operation of the respective window region.

25. The apparatus as in claim 24, wherein the corresponding circuit path includes a first circuit component and a second circuit component disposed in series; and wherein the node is disposed in the corresponding circuit path between the first circuit component and the second circuit component.

26. The apparatus as in claim 22, wherein the corresponding circuit path separates the respective window region into a first sub-window region through which a first portion of the near field wireless signal passes and a second sub-window region through which through which a second portion of the near field wireless signal passes.

27. The apparatus as in claim 1 further comprising:

a patch of metal;

wherein the individually controlled window regions of the tuner device include: a first controlled window region and a second controlled window region;

wherein each respective window region of the individually controlled window regions includes a corresponding circuit path extending through the respective window region, splitting the respective window region; and wherein a combination of the patch of metal, the first controller window region, and the second controlled window region are aligned in the first stack through which a portion of the near field wireless signal passes.

28. A method comprising:

receiving an input signal from an input feed at a source;

from the source, emitting a near field wireless signal based on the received input signal; and at a tuner device: i) receiving the near field wireless signal emitted from the source, and ii) individually controlling window regions of the tuner device to control a radiation pattern of a wireless output transmitted from the tuner device, wherein each of the multiple individually controlled window regions is substantially planar and is operative to modify attributes of a respective received portion of the near field wireless signal to produce a corresponding portion of the wireless output signal, wherein each stack of the multiple individually controlled window regions includes both a passive metal element and an active controlled circuit layer to convert the near field wireless signal into the wireless output.

29. The method as in claim 28 further comprising:

individually controlling settings of capacitances and resistances associated with each of the window regions, control of the settings modifying the radiation pattern of the wireless output transmitted from the tuner device.

30. The method as in claim 28 further comprising:

varying settings of the multiple individually controlled window regions, varying of the settings steering the wireless output from the tuner device in different desired directions.

31. The method as in claim 28, wherein individually controlling window regions of the tuner device includes:

controlling resonance frequency settings associated with each of the multiple individually controlled window regions.

32. The method as in claim 28, wherein each respective window region of the multiple individually controlled window regions controls radiation of a corresponding incident portion of the near field wireless signal received by the respective window.

33. The method as in claim 28, wherein the multiple individually controlled window regions include a first window region and a second window region, the second window region controlled individually with respect to the first window region.

34. The method as in claim 33 further comprising:

at the first window region, receiving a first portion of the near field wireless signal emitted from the source; and at the second window region, receiving a second portion of the near field wireless signal emitted from the source.

35. The method as in claim 34 further comprising:

via input control to the first window region, controlling a phase and amplitude of the received first portion of the near field wireless signal, the control of the first window region producing a corresponding first portion of the wireless output transmitted from the first window region; and via input control to the second window region, controlling a phase and amplitude of the received second portion of the near field wireless signal to produce a corresponding second portion of the wireless output transmitted from the second window region.

36. The method as in claim 35 further comprising:

via individually controlling the first window region and the second window region, steering the wireless output in a desired direction from the tuner device.

37. An apparatus comprising:

an input feed to receive an input signal;

a source from which to emit a near field wireless signal based on the received input signal; and a tuner device operable to receive the near field wireless signal emitted from the source to produce a wireless output, the tuner device including: i) multiple individually controlled window regions to control a radiation pattern of the wireless output transmitted from the tuner device, and ii) a first passive metal element aligned with a first controlled window region of the multiple individually controlled window regions.

38. The apparatus as in claim 37 further comprising:

a second passive metal element aligned with a second controlled window region of the multiple individually controlled window regions.

39. The apparatus as in claim 38, wherein a combination of the first passive metal element and the first controlled window region are aligned in a first stack; and wherein a combination of the second passive metal element and the second controlled window region are aligned in a second stack.

* * * * *